US007975957B2

(12) United States Patent
Lind et al.

(10) Patent No.: US 7,975,957 B2
(45) **Date of Patent: *Jul. 12, 2011**

(54) END PLUG FOR A ROLL OF MATERIAL, ROLL OF MATERIAL AND RETENTION MECHANISM IN A DISPENSER

(75) Inventors: Mats Lind, Hedemora (SE); Marcus Kullman, Borlange (SE); Stig Pommer, Hedemora (SE); Allan Salaker, Vikmanshyttan (SE); Bjorn Larsson, Billdal (SE); Helmut Unger, Bobingen (DE); Markus Backlund, Hedemora (SE)

(73) Assignee: SCA Hygiene Products AB, Gothenburg (SE)

( * ) Notice: Subject to any disclaimer, the term of this patent is extended or adjusted under 35 U.S.C. 154(b) by 275 days.

This patent is subject to a terminal disclaimer.

(21) Appl. No.: 12/092,082

(22) PCT Filed: Dec. 7, 2006

(86) PCT No.: PCT/EP2006/011776

§ 371 (c)(1),
(2), (4) Date: Apr. 30, 2008

(87) PCT Pub. No.: WO2007/065686

PCT Pub. Date: Jun. 14, 2007

(65) Prior Publication Data

US 2008/0283657 A1 Nov. 20, 2008

(30) Foreign Application Priority Data

Dec. 7, 2005 (EP) ..... 05026712

(51) Int. Cl.
*B65H 16/06* (2006.01)

(52) U.S. Cl. ..... 242/596.7; 242/129.51

(58) Field of Classification Search ..... 242/597, 242/599, 599.2, 599.3, 599.4, 129.51, 129.6, 242/596–596.8

See application file for complete search history.

(56) References Cited

U.S. PATENT DOCUMENTS 2,299,736 A 10/1942 Cavoto (Continued)

FOREIGN PATENT DOCUMENTS

AT 398747 6/1994

(Continued)

OTHER PUBLICATIONS

Decision on Grant, dated Nov. 8, 2010, in Application No. 2008127339.

*Primary Examiner* — William E Dondero
(74) *Attorney, Agent, or Firm* — Young & Thompson

(57) ABSTRACT

An end plug for a roll of material to be inserted into a retention mechanism, includes: a receiving portion for insertion in the roll, an end face for contacting the mechanism and a bearing member for insertion into the mechanism. The bearing member includes a bearing pin having a counter surface facing the end face and at least one portion for locking the end plug in an end position in the mechanism, the locking portion being positioned within a zone defined by a first surface extending towards the end face from an intersection position with the bearing pin, the first surface being inclined with respect to the longitudinal axis of the bearing pin by an angle of 117 and a second surface extending towards the end face from the intersection position, the second surface being inclined with respect to the axis of the bearing pin by an angle of 141.

37 Claims, 27 Drawing Sheets

U.S. PATENT DOCUMENTS

| | | | | |
|---|---|---|---|---|
| 3,387,902 | A | 6/1968 | Perrin et al. | |
| 3,416,744 | A | 12/1968 | Mott, Sr. et al. | |
| 3,572,602 | A | 3/1971 | Mott, Sr. et al. | |
| 3,700,181 | A | 10/1972 | Diring et al. | |
| 3,771,739 | A | 11/1973 | Nelson | |
| 4,108,389 | A | 8/1978 | Womack | |
| 4,230,286 | A | 10/1980 | Charles | |
| 4,307,639 | A | 12/1981 | DeLuca | |
| 4,340,195 | A | 7/1982 | DeLuca | |
| 4,342,431 | A | 8/1982 | Watellier | |
| 4,671,466 | A | 6/1987 | Jespersen et al. | |
| 5,501,415 | A * | 3/1996 | Harris et al. | 242/596.7 |
| 5,997,195 | A | 12/1999 | Burgin | |
| 6,824,091 | B2 * | 11/2004 | Inana | 242/578.2 |
| 2003/0164994 | A1 * | 9/2003 | Inana | 358/498 |
| 2003/0173451 | A1 | 9/2003 | Inana | |
| 2010/0078515 | A1 * | 4/2010 | Granger | 242/596.7 |

FOREIGN PATENT DOCUMENTS

| | | | |
|---|---|---|---|
| AU | 526 111 | B2 | 12/1982 |
| FR | 2868407 | | 10/2005 |
| FR | 2 879 090 | A | 6/2006 |
| RU | 1818294 | A1 | 5/1993 |
| SU | 1047784 | A | 10/1983 |
| SU | 1444263 | A1 | 12/1988 |
| SU | 1818294 | A1 | 5/1993 |
| WO | 96/23719 | | 8/1996 |
| WO | 9623719 | | 8/1996 |
| WO | 2005/094652 | A1 | 10/2005 |
| WO | 2005/094653 | A1 | 10/2005 |
| WO | 2007038957 | | 4/2007 |

* cited by examiner

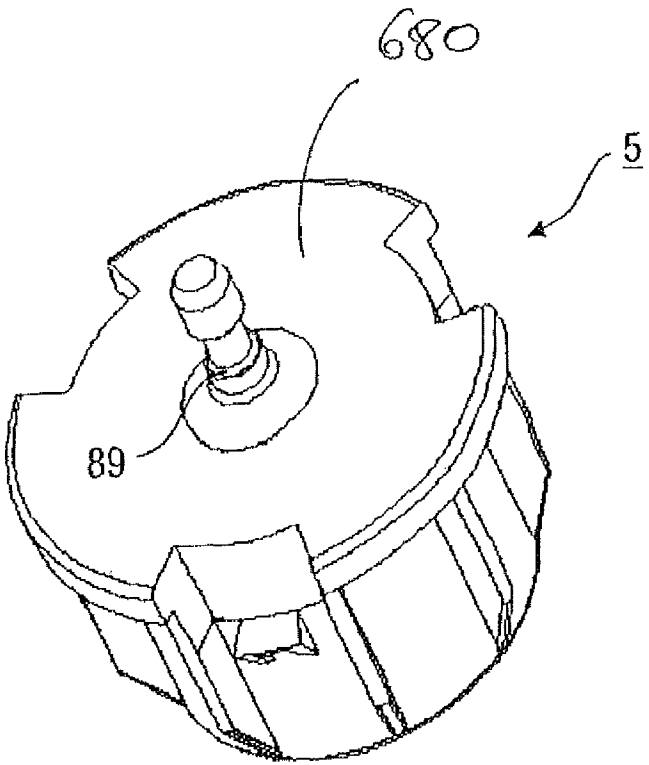
Fig. 3
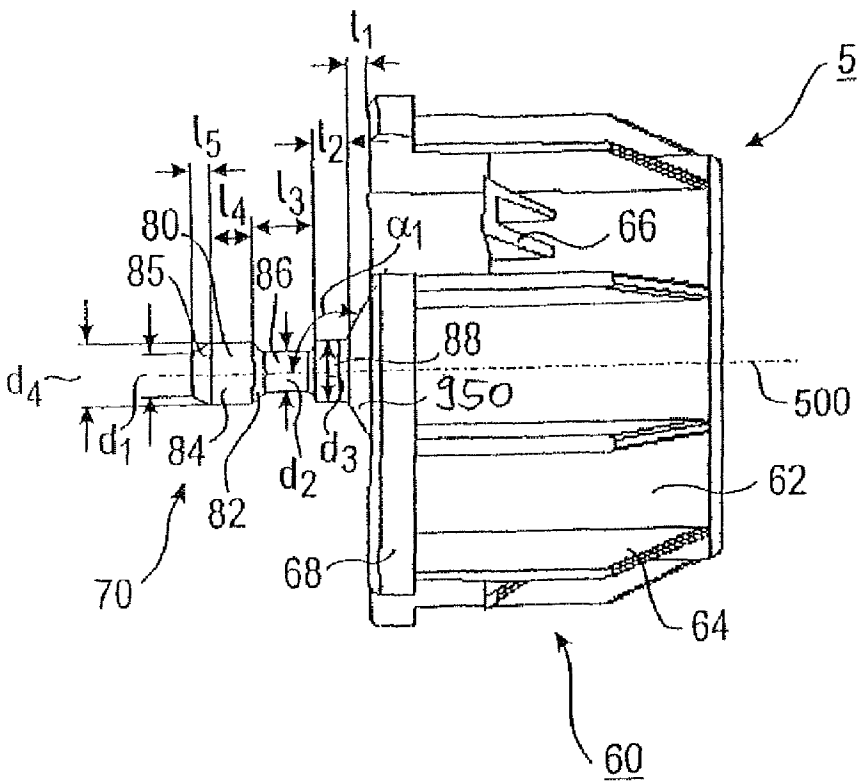

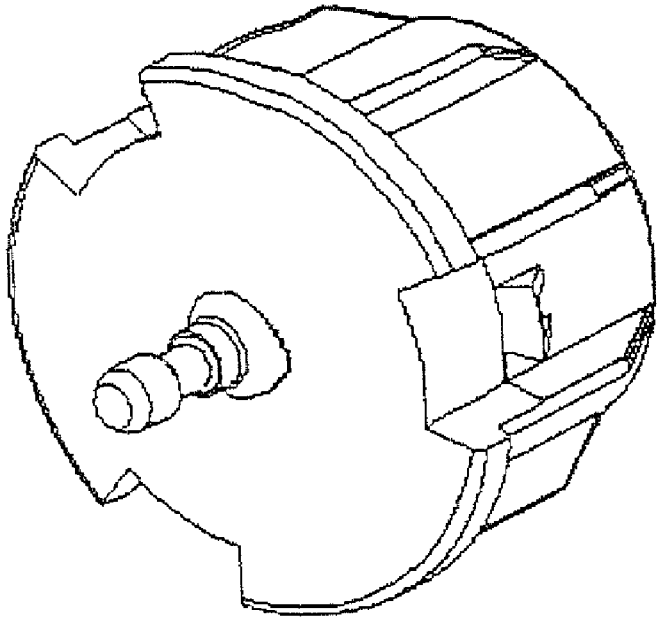
Fig. 6
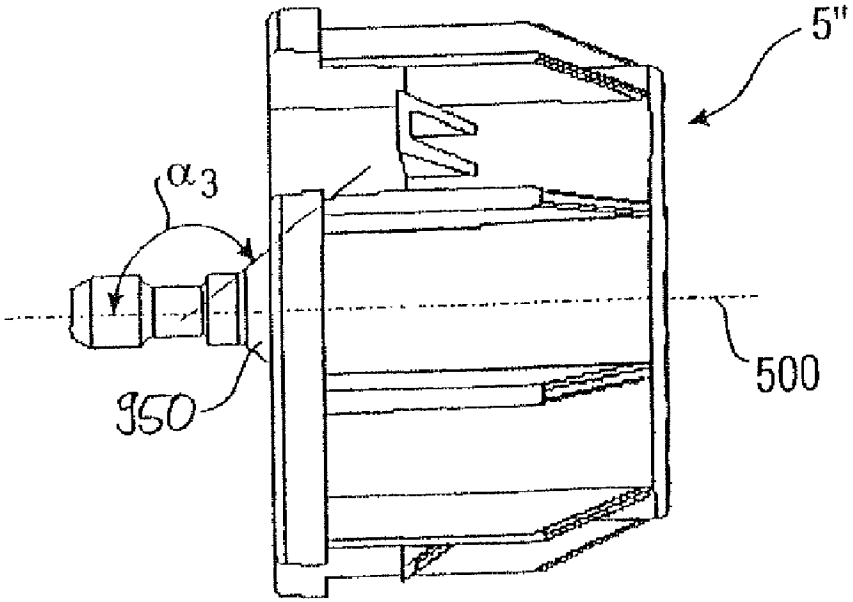

1
20
24
30
200
210
220
222
224
x

END PLUG FOR A ROLL OF MATERIAL, ROLL OF MATERIAL AND RETENTION MECHANISM IN A DISPENSER

1. TECHNICAL FIELD

The invention relates to the technical field of dispensers for exchangeable rolls of material, in particular tissue paper rolls, and the suitable geometry for inserting these rolls into these dispensers. In particular, the invention relates to an end plug for a roll of material, in particular a roll of tissue paper, to be inserted into a retention mechanism of a dispenser.

2. PRIOR ART

Numerous dispensers for dispensing paper towels, kitchen paper, toilet paper, foil, plastics wrapping sheet and other materials wound onto a roll are known in the art. Usually, such dispensers are provided with a supporting guiding bracket having support members in the form of arms upon each of which an end of an exchangeable roll is rotatably mounted. The support arm usually carries a hub member rotatably supported thereon over which one end of the roll core is inserted in replacing the roll.

U.S. Pat. No. 4,340,195 relates to a dispenser to accommodate source and reserve rolls of flexible sheet material which has a housing provided with inwardly facing tracks on the opposite inner side walls thereof and guide means associated with each track adjacent the lower end thereof to drivingly assist the source roll dispensing action with a reserve roll segregating device cooperating between the guide means and the reserve roll to both hold the reserve roll away from the dispensing position of the source roll and urge the guide means to brake against over-spin of the source roll incident withdrawal of sheet material there from.

U.S. Pat. No. 4,307,639 discloses a dispenser for wound rolls of flexible sheet material, such as paper towels, toilet tissue or the like having inwardly facing tracks on the opposite inner side walls of the dispenser housing to receive therein outwardly projecting spindles, carried by wound rolls to be dispensed for the rolls to move in succession downwardly relative to the tracks with a section of the lower end of each track slanting away from a feed roller mounted adjacent the lower end of the dispenser housing and each track having at such lower end section a pivotally mounted roll rotation driving guide biased toward the track centre to from the lower side of each track section slanting away from the feed roller. A serrated cutting knife is pivotally mounted within the feed roller to sever the sheet material, the serrations on the knife being spaced to accommodate there between the deformable eccentric segment and the conical portions on the pressure roller during initial projection of the knife from within the feed roller in severing the sheet material.

WO 2005/094653 A1 relates to a lock mechanism for a dispenser, an exchangeable roll of material and an end plug therefore and a method for inserting a roll of material into such a lock mechanism. The roll is provided with at least one end plug with a bearing pin for mounting the roll to the lock mechanism of the dispenser. The lock mechanism comprises a lock-housing with a guide slot for insertion of the bearing pin, the guide slot having a first section with a first width and a second section with a second width which is smaller than the first width. First and second sections are arranged in a direction perpendicular to the longitudinal extension of the guide slot and in a longitudinal direction of the bearing pin to be received. A sliding element is mounted to the lock housing and movable between a first position closing or narrowing the width of the guide slot and a second position opening the guide slot. A lock element is mounted to the sliding element and rotationally movable around an axis of rotation between a locked position and an unlocked position. The lock element is provided with an engagement portion which, in a locked position, is engaged with a locking geometry of the lock housing.

3. SUMMARY OF THE INVENTION

It is an object of the present invention to provide end plugs for a roll of material that improve the insertability of the end plugs in a retention mechanism as well as that they improve the locking forces and the exchangeability of the end plugs in the retention mechanism. Another object is to provide a retention mechanism for these end plugs.

The basic idea of the invention is to provide a concept of locking an end plug in a retention mechanism wherein the end plug comprises a locking portion for locking the end plug in an end position in the retention mechanism. The end position generally relates to the position that the end plug takes when the roll of material is in its operable dispensing position. The position of the locking portion on the end plug is located in a zone being defined between a first surface and a second surface such that a great variety of different structures is conceivable that can be used in connection with the retention mechanism of the present disclosure.

In particular, the end plug for a roll of material to be inserted into a retention mechanism comprises a receiving portion for being received in the roll of material, in other words with dimensions to fit into the roll of material. Provided are, furthermore, an end face for contacting the retention mechanism and a bearing member for being inserted into the retention mechanism, in other words with dimensions to fit into the retention mechanism. According to the inventive concept, the bearing member comprises a bearing pin that comprises a counter surface facing the end face and at least one locking portion for locking the end plug in an end position in the retention mechanism. As has been mentioned above, the locking portion forming part of the bearing member and being positioned in a zone defined by a first surface extending towards the end face from an intersection position with the bearing pin, the first surface being inclined with respect to the longitudinal axis of the bearing pin by an angle of 117°, and a second surface extending towards the end face from the intersection position, the second surface being inclined with respect to the longitudinal axis of the bearing pin by an angle of 141°.

This particular concept of an end plug with a locking portion that forms part of the bearing member and is located in a zone between the first surface and the second surface enables the provision of different structures that define the locking portion such that the individual geometry and design of the locking portion can be freely chosen in order to adjust the end plug to the particular needs of a user. As the structures are compatible with the retention mechanism, a reliable locking within the retention mechanism and defined locking forces can be achieved for all structures that have a locking portion positioned within the zone defined between the first surface and the second surface.

The different structures conceivable for the definition of the locking portion enable a fine adjustment of the end plug with respect to locking strength, stability of the plug in general, complexity of the moulding tools and material consumption. The latter two aspects also relate to the cost of the end plug.

The aspects described above, in particular with respect to the position of the locking portion, provide an end plug with a locking portion that provides the necessary insertability and, at the same time, locking force.

Furthermore, this particular arrangement of the locking portion which serves to lock the end plug in an end position has several advantages over simply providing the conventional pin without any additional locking portion. An end plug with the additional locking portion can, on the one hand, be slid easier into the retention mechanism but supports, on the other hand, higher loads without being deformed. As the locking portion is necessarily situated between the first and the second inclined surfaces, structures are conceivable that cannot easily be deformed as the locking portion has generally a wide basis on the end face of the end plug.

In a preferred embodiment, the intersection position is spaced apart from the end face by 2 mm. This particular embodiment enables a definition of the position of the locking portion that is compatible with the retention mechanism of the present disclosure. Preferably, the end face defines a contact plane for contacting the retention mechanism wherein the contact plane faces the counter surface. In another embodiment, the intersection position is spaced apart from the contact plane by 2 mm.

Depending on the effect that is intended for the locking portion, it might be advantageous when the second surface is inclined with respect to the longitudinal axis of the bearing pin by an angle of 119°. Accordingly, the volume of the zone in which the locking portion is positioned can be decreased with the positive effect that the end plug can be slid into a retention mechanism more smoothly but provides basically the same locking forces in the end position. Accordingly, the insertion, bearing and locking properties can be improved.

In the latter preferable embodiment, the position of the locking portion could be further positioned in a zone defined by a third surface extending from the intersection position towards the end face, the third surface being inclined with respect to the longitudinal axis of the bearing pin by an angle of 122°, and a fourth surface extending from the intersection position towards the end face, the fourth surface being inclined with respect to the longitudinal axis of the bearing pin by an angle of 141°, wherein the locking portion is situated either between the first surface and the second surface or between the third and the fourth surface. The provision of a locking portion in the zones defined between the first and second surfaces and the third and fourth surfaces enables a smooth insertion of the end plug and a great variety of different structures that can be used in combination with the retention mechanism.

The end plug also comprises a receiving portion for being received in the roll of material, in other words with dimensions to fit into the roll of material, an end face defining a contact plane for contacting the retention mechanism and a bearing member for being inserted into the retention mechanism, in other words with dimensions to fit into the retention mechanism, the end face being situated between the bearing member and the receiving portion. The bearing member according to the inventive concept comprises a bearing pin which comprises at least a first portion of a first outer diameter, a second portion of a second outer diameter, and a third portion of a third outer diameter, the second portion being situated between the first portion and the third portion, and the second outer diameter being smaller than the first outer diameter and the third outer diameter, wherein the third portion being positioned closer to the end face than the first portion. Furthermore, at least one locking portion for locking the end plug in an end position in the retention mechanism is provided, the locking portion forming part of the bearing member and being situated closer to the end face than the second portion of the bearing pin, wherein the locking portion has at least one extension that is larger than the first, second and third outer diameters of the bearing pin.

This end plug also enables the provision of a locking portion can be defined by a great variety of different structures on the end plug and that can be customised to the needs of the user while providing improved insertion, bearing and locking properties.

The locking portion can be defined by a truncated cone, the base of the truncated cone being situated adjacent the end face and the top of the truncated cone being situated adjacent the bearing pin. The top of the truncated cone may have a diameter substantially corresponding to the third outer diameter of the bearing pin, in particular a diameter of 5 mm.

In a preferred embodiment, the outer surface of the truncated cone is inclined with respect to the longitudinal axis of the bearing pin by an angle of less than 117°. In this particular embodiment, it is preferred if the outer surface of the truncated cone intersects with the bearing pin in a position spaced apart from the end face by less than 2 mm, in particular less than 1.5 mm. These specific measures enable a very flexible design of an end plug wherein, at the same time, the surface of the truncated cone is still compatible with the retention mechanism and provides improved insertion, locking and bearing properties. The truncated cone can be adapted to the specific needs with respect to stability, slidability and material consumption.

In a specific case, the truncated cone has also improved properties with regard to the production of the end plug in that the occurrence of an air bubble in the bearing pin can be reduced and/or the position of the air bubble can be moved towards an end of the bearing pin such that the stability of the bearing pin is not compromised. It is self-evident that a truncated cone must have an inclination angle with respect to the longitudinal axis of the bearing pin that is larger than 90° in order to be called a cone.

Preferably, the locking protrusion is rotationally symmetric with respect to the longitudinal axis of the bearing pin. This specific embodiment has the advantage that the end plug provides for a smooth and steady movement when it is turned around the longitudinal axis. However, locking portions which are not rotationally symmetric e.g. rectangular or fragmented, are also conceivable as long as they are situated in the sections defined above and as long as they provide the necessary locking force in combination with the retention mechanism.

In a preferred embodiment, the locking portion can be defined by a ring-shaped structure situated on the end face, and the summit portions of the ring-shaped structure may define the locking portion. This specific embodiment may be advantageous when a roll of material is to be removed from the retention mechanism in order to exchange it with a fresh roll as it may be shaped in a form such that it can be removed more easily when the roll of material is used up.

In another preferred embodiment, the locking portion is defined by a stepped structure situated on the end face, wherein at least one corner portion of the stepped structure can define the locking portion. With respect to this embodiment, basically the same comments as above with respect to the ring-shaped structure apply. In addition to that, the stepped structure may be easier to manufacture and the moulding tools may be less complicated compared to the situation of the truncated cone, as no inclined surfaces are present.

In yet another preferred embodiment, the locking portion is defined by a chamfered structure situated on the end face, wherein at least one portion of the chamfered structure defines the locking portion. This specific embodiment allows for relatively low wear and is, thus, practical for use in end plugs that are to be re-used or for heavier rolls of material with relatively long webs of material.

In another embodiment, the locking portion is defined by a basically cylindrical structure situated on the end face, wherein at least one corner portion of the basically cylindrical structure defines the locking portion. The technical effects of this embodiment basically correspond to the stepped structure mentioned above but the end plug has a yet simpler structure which leads to a yet simpler moulding tool.

In still another embodiment, the locking portion being defined by a hemispherical structure and/or other substantially spherical surface, wherein at least one tangential portion of the hemispherical structure and/or other substantially spherical surface defines the locking portion. The technical effects of this embodiment basically correspond to the ones mentioned with respect to the chamfered structure above but the moulding tool might have a still simpler structure as no corner portions are present.

In another preferred embodiment, the end face comprises recesses, wherein the end face may comprise a rim defining the contact plane. This embodiment has the advantage that the material consumption can be reduced due to the recesses, preferably without compromising the overall strength of the end plug. This additional strength can be achieved by, e.g. providing additional supporting structures. The contact plane may still abut against an outer wall of the retention mechanism in order to provide the necessary guiding function.

The end plug as described above can be used for fitting it into the hollow core of a roll of material, in particular a paper towel roll or a tissue paper roll.

The present invention, furthermore, provides a roll of material for use in a retention mechanism which is provided, at least at one longitudinal end of the roll, with an end plug as described above.

A retention mechanism in a dispenser for retaining an end plug of an exchangeable roll of material is defined by a housing with an insertion slot for inserting a bearing member of the end plug, the insertion slot being arranged between an upper and a lower guide rail, the guide rails having at least an inclined sliding surface for interaction with an inclined locking portion of the bearing member. Furthermore, a locking member formed in at least one of the guide rails is provided, the locking member being formed such that it interacts with the inclined locking portion of the bearing member for retaining the end plug in an end position and a counter bracket being arranged in the housing, said counter bracket having a guiding slot for guiding the bearing pin of the bearing member.

Such a retention mechanism ensures that the interaction between the end plug, as described above, and the retention mechanism itself allows easier insertion and removal of the end plug or a roll of material and ensures a locking force in the desired range of 15N to 19N, in particular 18N to 19N.

The provision of a locking force is particularly of importance if the insertion slot is inclined with respect to the horizontal plane, e.g. by 6°. The locking force then serves to keep the roll of material in place against the gravitational forces and against the pull forces exerted when a user pulls a paper towel out of the dispenser.

Preferably, the locking member is formed on the inclined sliding surface of one of the guide rails. The locking member can be a protrusion extending perpendicular to the insertion slot.

To achieve defined insertion and removal characteristics, the locking member can have a first sloped portion arranged, in the insertion direction, before the locking member and a second sloped portion arranged, in the insertion direction, behind the locking member, the first sloped portion having a smoother slope than that of the second sloped portion. The sloped portions thus formed ensure a proper interaction with the inclined surface of the end plug and ensure easy insertion and proper locking forces. The asymmetrically formed slope portions allow different insertion forces and removal forces of the end plug when inserted into and pulled out of the retention mechanism. In other words, these features relate to a retention mechanism that allows easy insertion of a roll but retains the roll securely in the retention mechanism.

In a preferred embodiment, the locking member is formed by decreasing the inclination angle of the inclined sliding surface of the guide rail. This leads to an interaction with the inclined locking portion of the end plug which presses the end plug out of the insertion slot in a direction in the longitudinal axis of the bearing pin.

Preferably, the inclined sliding surfaces are inclined with respect to a plane extending in the insertion direction of the insertion slot and perpendicular to an outer surface of the housing by an angle to the plane in the range of 117° to 141°. Preferred, the angle is chosen in a range of 120° to 122°. In a specifically preferred embodiment, the inclination angle is 121.1°. These angles ensure that an interaction with the inclined locking portions of the end plug is possible and a smooth insertion of the end plug into the end position of the retention mechanism is ensured.

In a further preferred embodiment, a prevention member is provided in the insertion slot for prevention of the insertion of an end plug with incorrect dimensions. By the provision of this prevention member, it can be ensured that only rolls with suitable dimensions and suitable material are inserted into the retention mechanism and, in addition to this, it can be ensured that a roll of material is inserted in the correct orientation when providing different plugs on the ends of the material rolls.

It is preferred that the counter bracket carries a locking protrusion for retaining the end plug in its end position, the locking protrusion of the counter bracket extending in a direction opposite to that of the locking protrusion of the guide rail in the end position. Preferably, the counter bracket is pivotable within in the housing. Such a counter bracket helps to reject unsuitable end plugs and keeps suitable end plugs reliably in an end position.

4. BRIEF DESCRIPTION OF THE DRAWINGS

In the following, exemplary embodiments of the invention will be described in detail with reference to schematic drawings, in which:

FIG. 3 is a side view and a perspective view of an end plug in a second variant;

FIG. 6 is a side view and a perspective view of the end plug in a fourth variant;

5. DETAILED DESCRIPTION OF THE PREFERRED EMBODIMENTS

Figure 1:
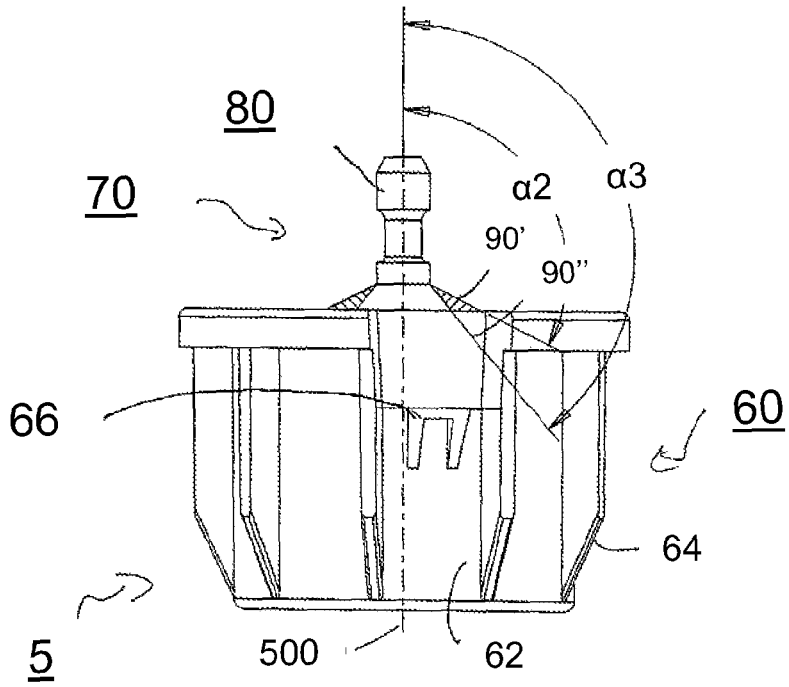
FIG. 1 is a schematic perspective side view of an end plug and an enlarged portion of the end plug.
Figure 1:
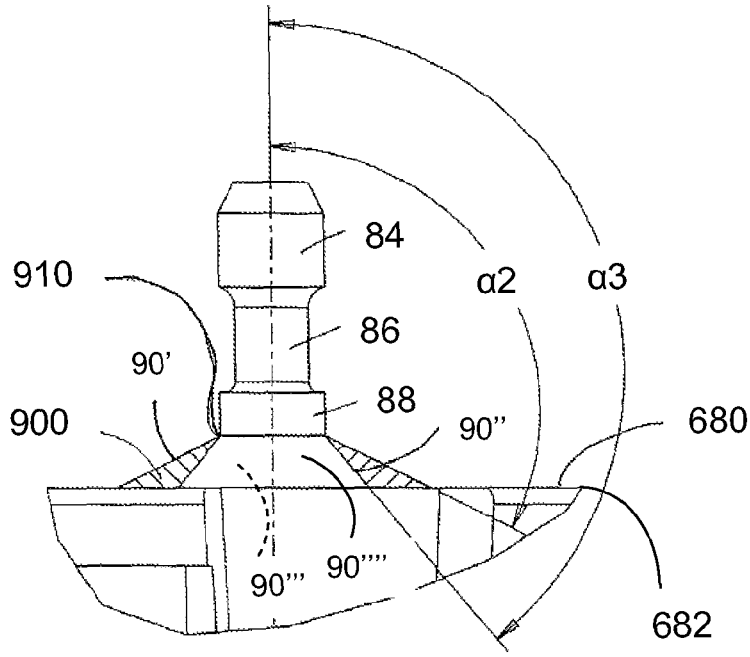

In the following description of preferred embodiments of the invention, corresponding parts or elements in the different drawings will be denoted by the same reference numerals.

Figure 2:
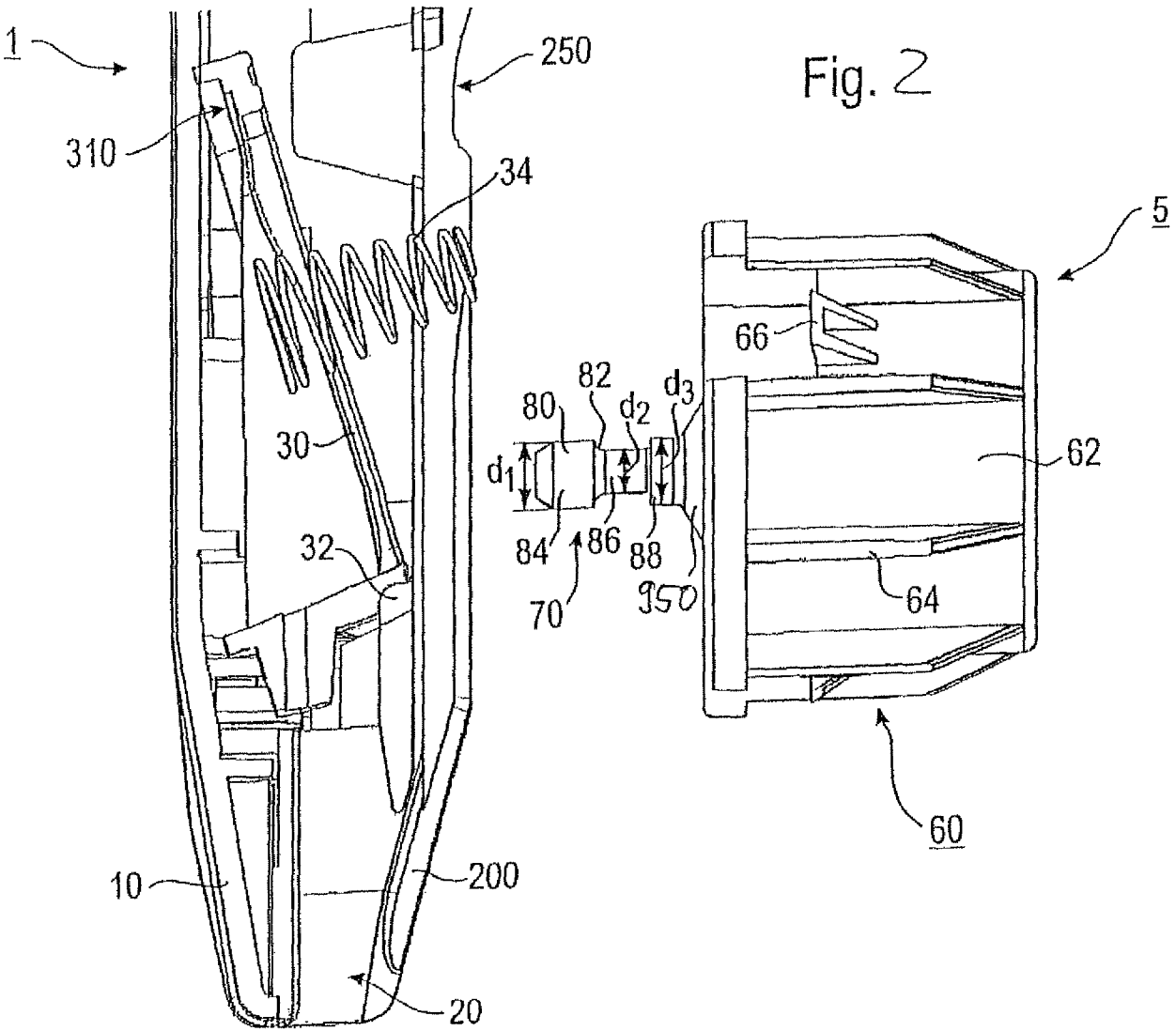
FIG. 2 is a schematic cross-section of a retention mechanism and a side view of an end plug in a first variant.

FIG. 1 is a schematic perspective side view of an end plug 5 that is to be retained in a retention mechanism 1 shown e.g. in FIG. 2. FIG. 1, furthermore, shows an enlarged view of a relevant portion of the end plug 5. The end plug shown in FIG. 1 is a general illustration of the end plug of the present disclosure.

The end plug 5 has a receiving portion 60 for being received in a roll of material, in other words with dimensions to fit into a hollow core (not shown) of a roll of material (not shown), in particular a roll of tissue paper material such as paper towels or toilet paper. The receiving portion comprises a cylindrical portion 62 and a plurality of ribs 64 that expand radially from the cylindrical portion 62. The hollow core of the roll of material is fitted onto the summit portions of the radially expanding ribs 64. A fluke portion 66 that is equally extending radially from the cylindrical portion 62 of the receiving portion 60, serves to hold the hollow roll of material in place when the end plug is fitted into the core. The fluke portions 66 extend beyond the radial expansion of the ribs 64 such that they enter into the core material in order to secure the end plug in the core.

The end plug 5 comprises a bearing member 70 for being inserted into the retention mechanism, the bearing member 70 extending away from the receiving portion in the axial direction of the end plug 5. The bearing member 70 has a bearing pin 80 which comprises a counter surface 82 that faces into the direction of the receiving portion 60.

The counter surface 82 of the bearing pin 80 is formed by a first portion 84 of the bearing pin of a first outer diameter $d_1$ that springs back into a second portion 86 of the bearing pin that has an outer diameter $d_2$, whereas the first diameter $d_1$ is larger than the second diameter $d_2$. The counter surface 82 is situated between the first portion 84 and the second portion 86 of the bearing pin 80. The counter surface 82 may have different forms and can be inclined with regard to the longitudinal axis of the bearing pin, perpendicular to the longitudinal axis of the bearing pin 80 or chamfered.

Furthermore, the bearing pin 80 includes a third portion 88 of a third outer diameter $d_3$ whereas the third outer diameter $d_3$ is shown in the embodiment to be equal to the first diameter $d_1$. The second portion 86 of the bearing pin 80 is situated between the locking portion and the first portion 84 of the bearing pin 80.

An end face 680 is present that is directed towards the counter surface 82 of the bearing pin 80, the end face being adapted to abut against an outer wall of the retention mechanism.

A first surface 90', a second surface 90", a third surface 90'" and a fourth surface 90"" are shown which enclose a zone 900. The zone 900 corresponds to the zone within which a locking portion 950 for locking the end plug in an end position can be positioned such that end plug 5 can be locked in an end position 250 in the retention mechanism 1. In this general view of FIG. 1, a specific geometrical structure defining the locking portion is not shown. However, a number of conceivable geometric structures defining the locking portion are shown and described in the following figures.

The locking portion is defined as the portion of the bearing member 70 that serves for locking the end plug in the end position 250 in the retention mechanism 1. Accordingly, an interaction between the bearing member 70 of the end plug and a locking member 220 of the retention mechanism 1 (see below e.g. FIGS. 30 to 34) takes place in the locking portion.

The first surface 90' intersects in an intersection position 910 with the bearing pin 80 at the third portion 88 of the bearing pin 80. In particular, the intersection position 910 of the first surface 90' with the bearing pin 80 is spaced apart from the longitudinal axis 500 of the end plug 5 by a distance that corresponds to the outer diameter $d_3$ of the third portion 88 of the bearing pin 80 and is spaced apart from the end face 680 of the end plug 5 by a distance d. In a preferred embodiment, distance d is chosen to be 2 mm and the third outer diameter $d_3$ is chosen to be 5 mm.

The first surface 90' extends towards the end face 680 from the intersection position 910 and is inclined with respect to the longitudinal axis 500 of the bearing pin 5 by an angle of 117°. The second surface 90" also extends towards the end face 680 from the intersection position 910 but is inclined with respect to the longitudinal axis 500 of the bearing pin 80 by an angle of 141°.

The zone 900 between the first surface 90' and the second surface 90", and also end face 680, symbolizes the different possible positions of a locking portion of the bearing member 70. As will be shown in the following embodiments, in particular in the embodiments of the end plug shown in FIGS. 2 to 6 and 25 to 30, several solutions for a structure that provides a locking portion 950 are conceivable that provide a reliable locking function in the retention mechanism 1. In particular, the embodiments shown in the above-mentioned Figures all have at least one locking portion 950 which is positioned in the respective zone 900. In other words, the position of the locking portion is confined between the first surface 90' and the second surface 90".

Figure 4:
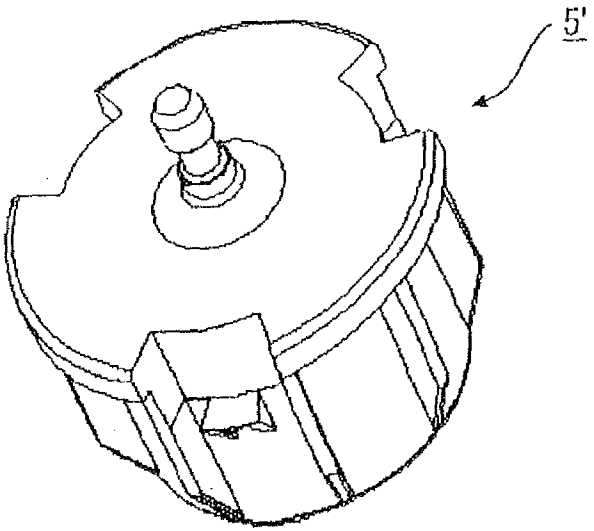
FIG. 4 is a side view and a perspective view of an end plug in a third variant.

It will be appreciated that the zone 900 which shows the possible positions of the locking portions of the end plug directly corresponds to a combination of the embodiments shown in FIGS. 4 and 6, which define the extreme positions of the locking portion. In particular, the locking portion 950 of FIG. 4 corresponds to the first surface 90' and the locking portion 950 of FIG. 6 corresponds to the second surface 90" in FIG. 1. In other words, FIG. 4 and FIG. 6 define the extreme positions of a locking portion and, at the same time, enclose the zone 900 as it is defined with respect to FIG. 1. In other words, the zone 900 can be obtained by simply overlaying the end plugs shown in FIGS. 4 and 6. The embodiment shown in FIG. 3 with a locking portion 950 that is inclined with respect to the longitudinal axis 500 of the bearing pin 80 by $\alpha_1$=121.1° is another example of an embodiment of a locking portion 950 that is directly situated within the zone 900 in FIG. 1.

It will be appreciated that a locking portion will be understood to be positioned in the zone defined between the first surface and the second surface if at least one section of a locking portion is positioned within this area. Accordingly, a locking portion will be understood to be positioned within the first surface and the second surface if it also extends beyond these surfaces. However, the locking function for locking the end plug in an end position in the retention mechanism 1 will essentially take place in the sections of the locking portions that are confined between the first surface and the second surface.

In an embodiment that is not shown, the end face 680 of the end plug 5 is structured such that it comprises recesses. However, the end face 680 still defines a contact plane or rim 682 which serves to abut against an outer wall of the retention mechanism in the same manner as it is explained for the end face 680 in the embodiments explicitly shown. In particular in an embodiment that uses the recesses in the end face 680 in order to save material, the portions of the end face 680 which extend the most towards the outer wall of the retention mechanism when the end plug 5 is inserted into the retention mechanism define this contact plane. The contact plane could be defined, e.g., by a rim that extends around the circumference of the end face.

FIG. 2 is a cross-section through a retention mechanism 1 and a side view of an end plug 5 that can be retained in the retention mechanism 1.

The retention mechanism 1 comprises a housing 10 which is preferably made from a moulded plastic material. The housing 10 comprises an insertion slot 20 for the insertion of the bearing member 70 of the end plug 5. A counter bracket 30 is pivotably arranged within the housing 10 and can pivot about a pivoting axis 32. The counter bracket 30 is pretensioned towards an insertion position by a spring 34 which is schematically shown in FIG. 1.

The insertion slot 20 is formed by an upper and a lower guide rail in the housing, the upper guide rail 200 of which is shown in the cross-section of FIG. 1. The insertion slot 20 has an end position 250 in which the end plug 5 is retained in its end position.

The end plug 5 of this embodiment basically corresponds to the one shown and described in FIG. 1 and includes a locking portion 950 for locking the end plug in an end position in the retention mechanism 1, the locking portion 950 being arranged between the receiving portion 60 and the bearing pin 80. The locking portion 950 is inclined with respect to the longitudinal axis of the bearing pin by an angle in the range of 117 to 141, in particular 120 to 122, preferably of 121.1. Accordingly, the locking portion 950 lies entirely within the zone 900 defined with respect to the end plug described in FIG. 1 and also acts in its entirety as the locking portion 950 for locking the end plug in the retention mechanism.

The locking portion 950 and the counter surface 82 are arranged such that they are inclined in opposite directions. In other words, the two surfaces are arranged to constitute a potential well.

The interaction of the end plug 5 with the retention mechanism 1 will become more apparent in the description of the following FIGS. 6 to 32. In short, the locking portion 950 interacts with the respective sliding surfaces of the guide rails and interacts with a locking member in order to lock the end plug 5 in its end position 250. The counter surface 82 is in contact with the guiding bracket 30 and interacts with the end section 310 of the guiding bracket 30. In the end position 250, the locking force of the end plug 5 in the retention mechanism 1 is, due to the specific geometry of the retention mechanism 1 in interaction with the bearing member of the end plug in the range of 15N to 19N. This very narrow band of locking force is necessary, on the one hand side, to keep the roll of material in place and securely fasten the roll of material in the end position 250 but, on the other hand, enables an easy insertion and removal of the roll of material when the roll has to be exchanged.

FIG. 3 is a side view and a perspective view of an end plug 5. The end plug 5 is basically identical to the end plug shown in FIG. 2. The angle $\alpha_1$ that is measured between the longitudinal axis 500 of the end plug 5 and the locking portion 950 is 121.1°. The longitudinal axis 500 of the end plug 5 is, at the same time, the longitudinal axis of the bearing pin 80.

The further dimensions shown in FIG. 3 are $d_1$=5.0+−0.2 mm $d_2$=3.5+−0.1 mm, $d_3$=5.0+−0.2 mm and $d_4$=3.5+−0.1 mm. $d_4$ is the front end face diameter of the bearing pin 80 which is reached at the end of the chamfer 85.

A limiting member 68 is arranged between the receiving portion 60 and the bearing member 70. The limiting member 68 is for limiting the depth of insertion of the receiving section 60 of the end plug 5 into the hollow core of the roll of material. In other words, the limiting member 68 serves the purpose to bring the end plug 5 into a defined position with regard to the hollow core of the material roll. The face of the limiting member 68 directed towards the bearing pin 80 serves, at the same time, the end face 680 of the end plug.

The bearing member 70 exhibits the following dimensions in the longitudinal direction of the longitudinal axis 500. The length $l_1$ of the locking portion 950 in the longitudinal direction is 2 mm. The length $l_2$ of the third portion 88 of the bearing pin 80 is 2.5 mm. The length $l_3$ of the second portion 86 of the bearing pin 80 is 5 mm. The length of the distal-most portion of the bearing pin 80 is $l_4+l_5$=5 mm, whereas the first portion 84 has a longitudinal extension of $l_4$=3.5 mm and the chamfered portion 85 has a longitudinal extension of $l_5$=1.5 mm.

A radius of a chamfer 89 between the second portion 86 and the third portion 88 of the bearing pin 80 has a radius of 0.5 mm. The same radius can be present in the foot area of the locking portion.

The chamfer 89 is particularly helpful during the molding process of the end plug 5 since an air bubble that appears embedded randomly in the smaller diameter portion 86 of the bearing pin 80 can be moved by the provision of the chamfer 89 into the larger diameter portion 84. Thus, the chamfer 89 helps to improve the stability of the bearing pin of the end plug.

FIG. 4 shows another end plug 5'. The end plug 5' shown in FIG. 4 is almost identical to the one shown in FIG. 2 except that the locking portion 950 is inclined towards the longitudinal axis 500 of the bearing pin 80 by an angle of $\alpha_2$ of 117°.

Figure 5:
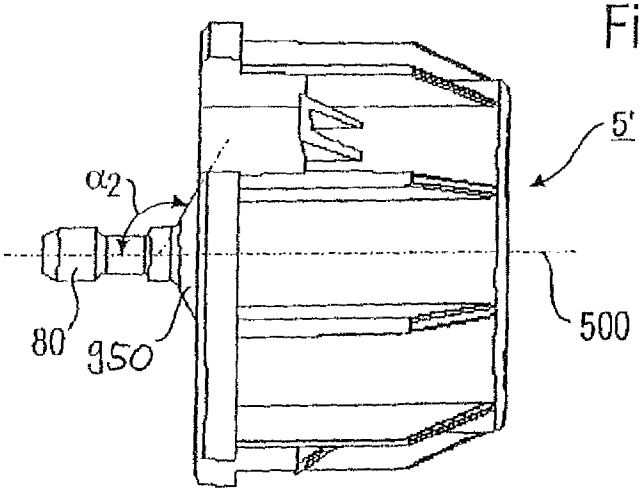
FIG. 5 is a cross-section of the retention mechanism with the end plug of FIG. 4 inserted therein.
Figure 5:
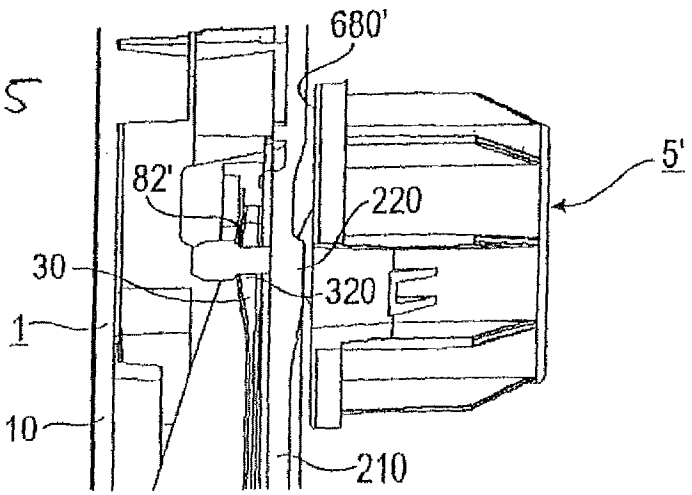

The interaction of the locking portion 950 of this end plug 5' with the retention mechanism 1 can be seen in FIG. 5. The interaction of the locking portion 950 with the upper guide rail 210, in particular with a locking protrusion 220 of the upper guide rail 210, leads to a situation in which the end face 680' of the end plug 5' is lifted off the outer surface of the retention mechanism 1 in order to overcome the locking protrusion 220.

FIG. 6 shows yet another end plug 5", which is substantially identical to the end plugs shown in FIGS. 3 and 4 except for the inclination angle of the locking portion 950. In the third embodiment of the end plug 5", the inclination angle $\alpha_3$ of the locking portion 950 is 141°.

From the discussion of FIGS. 3 to 6, it follows that the position of the locking portion for locking the end plug in the end position in the retention mechanism is of outmost importance. For a position of the locking portion in a zone that is defined between two surfaces with angles of 117° and 141°, the end plug can, on the one hand, be slid into the end position and, on the other hand, can be locked with an reasonable locking force in the end position of the retention mechanism.

This is of particular interest since, on the one hand, the locking force has to be high enough to keep the end plug reliably in its end position upon use but, on the other hand, the loading and removing of the rolls has to be easy in order to give the operator the perception of a hassle-free exchange of the rolls and, additionally, prevent the locking mechanism and the end plug from being destroyed.

Figure 7:
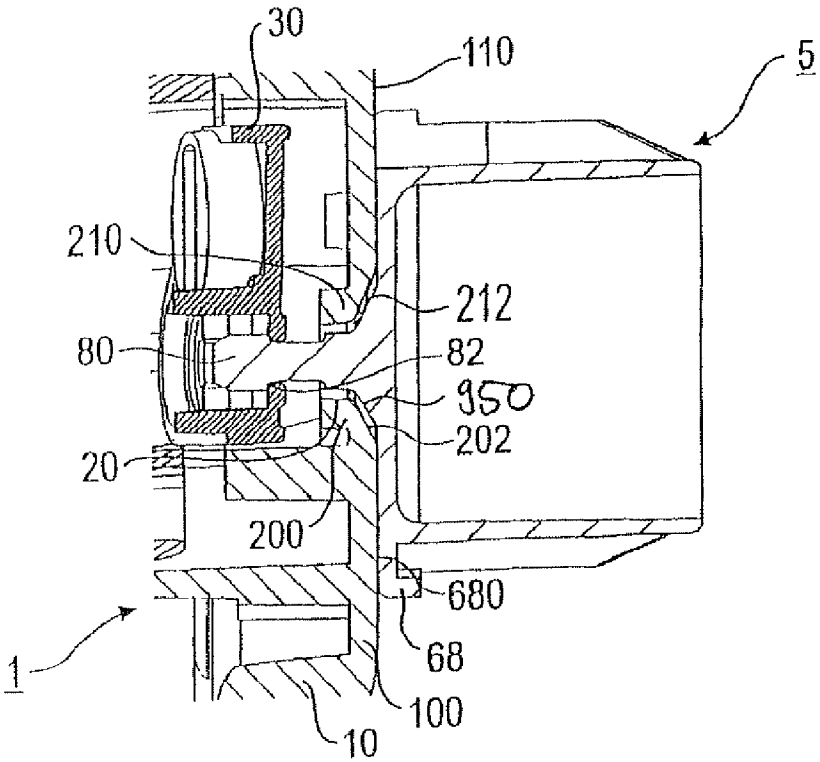
FIG. 7 is a front view cross-section of the retention mechanism and the end plug according to FIG. 3 inserted therein.

FIG. 7 is a front-view cross section of the retention mechanism 1 and the end plug 5 of the (with a locking portion of an inclination angle of 121.1°) inserted into the retention mechanism 1. Here, a situation is shown in which the end plug 5 is inserted into the insertion slot 20 and the counter surface 82 of the bearing pin 80 is engaged with the counter bracket 30 and, consequently, pulls the counter bracket 30 in the direction of the end plug 5. The counter surface 82 exerts a force onto the counter bracket 30 in the direction of the longitudinal axis 500 of the bearing pin 80, the force acting perpendicular to the insertion direction of the insertion slot 20 and resulting in swinging the counter bracket towards the outer wall 100 of the housing 10. The outer surface 110 of the outer wall 100 of the housing 10 and the end face 680 of the limiting member 68 are in contact with each other and provide the reaction force to the pulling force that is exerted onto the counter bracket 30.

The insertion slot 20 is formed in the outer wall 100 of the housing 10 and comprises a lower rail 200 and an upper rail 210 whereas the lower rail 200 has an inclined sliding surface 202 and the upper guide rail 210 has an inclined sliding surface 212. The inclined sliding surfaces 202, 212 are inclined such that their inclination angle substantially corresponds to the inclination angle of the locking portion 950 of the bearing member 70 of the end plug 5. In the current case this means that the inclined sliding surfaces 202, 212 are inclined by an angle of 121.1°. Depending on the end plug used, the inclination could also be chosen to be in a range of 117° to 141°, and in particular 120° to 122°.

In the position of the end plug 5 shown in FIG. 7, the inclined surfaces 202, 212 of the insertion slot 20 do not necessarily, however, abut against the locking portion 950 of the end plug 5.

Figure 8:
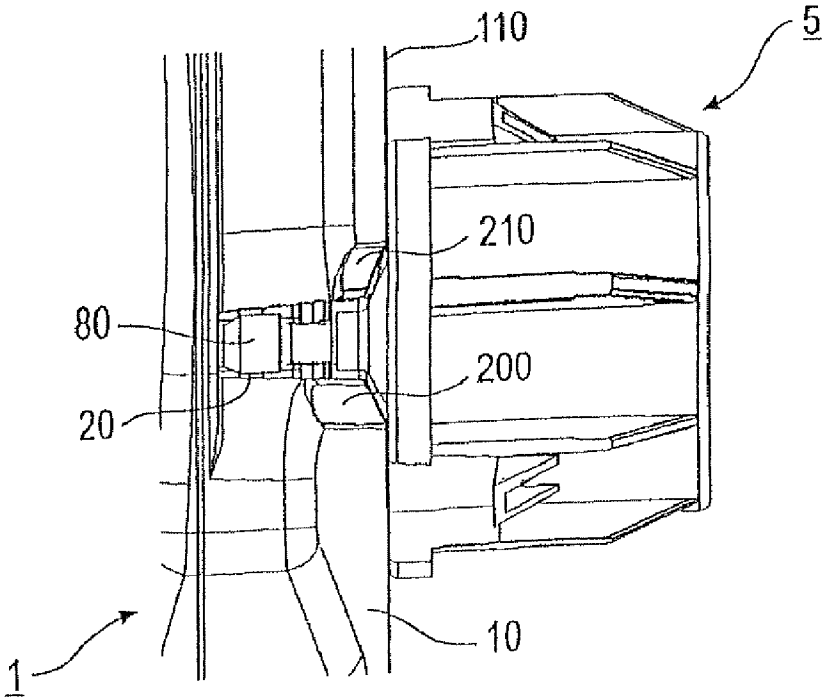
FIG. 8 is a non-sectioned front view of FIG. 7.

FIG. 8 shows the end plug 5 in the retention mechanism 1 in the same configuration as shown in FIG. 7 but in a non-sectioned view. In this Figure it is clearly visible how the bearing pin 80 enters into the insertion slot 20 and how it is guided along the insertion slot such that the end plug 5 can only slide along the insertion slot 20.

Figure 9:
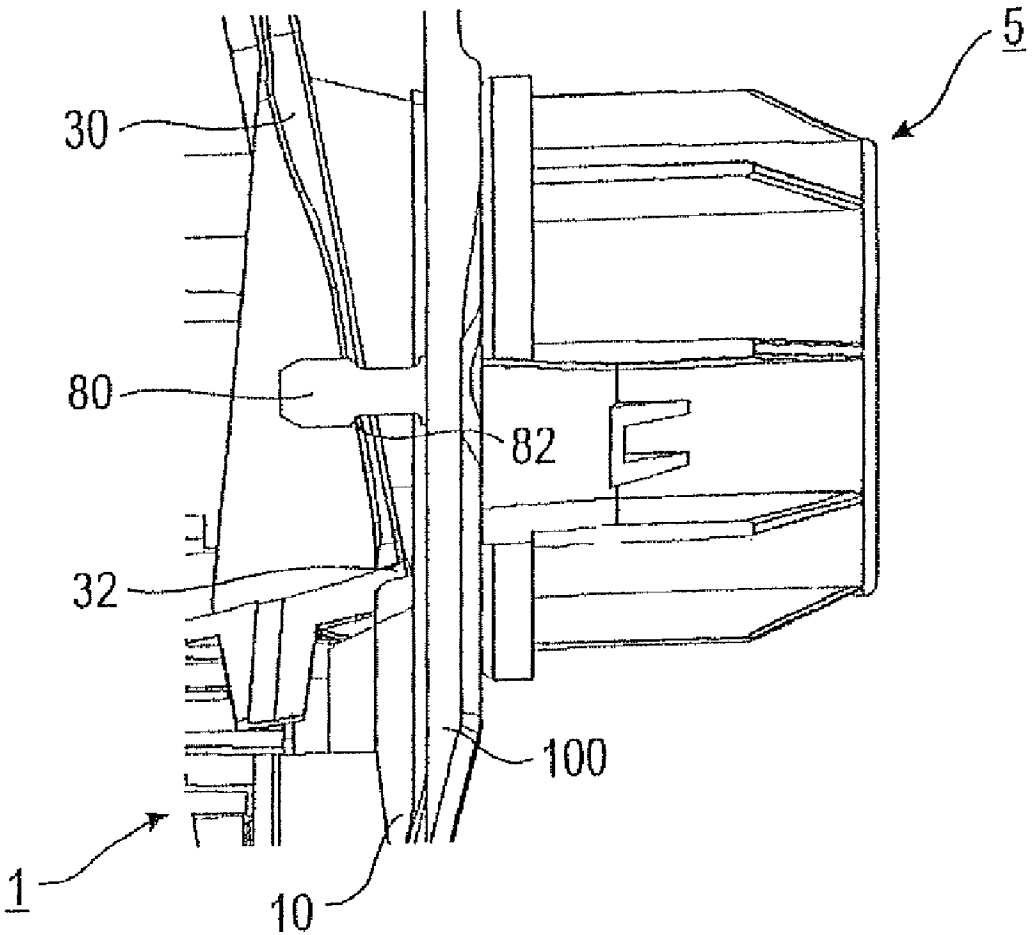
FIG. 9 is a top view of the arrangement of FIGS. 7 and 8 with parts of the housing of the retention mechanism cut away.

FIG. 9 is an illustration of the end plug in a top-view cross section, the end plug 5 being further slid into the insertion slot of the retention mechanism 1. In this illustration it becomes even clearer how the interaction between the counter surface 82 of the bearing pin 80 with the counter bracket 30 brings the counter bracket 30 more and more in an orientation towards the outer wall 100 of the housing 10. In other words, the interaction of the counter surface 82 of the bearing pin 80 and the counter bracket 30 pivots the counter bracket 30 around the pivoting axis 32 of the counter bracket 30 towards the outer wall 100 of the housing 10 such that, in the end position of the counter bracket 30, the counter bracket 30 is in parallel to the outer housing wall 100 and, thus, parallel to the insertion direction of the end plug 5.

FIGS. 10 to 14 show the end plug 5 and the retention mechanism 1 in different views in a position in which the end plug 5 is moved further towards the end position. In particular, in FIG. 10 a situation is shown in which the end plug is moved this far that the inclined surface 212 of the upper rail 210 begins to abut against the locking portion 950 of the end plug 5.

Figure 11:
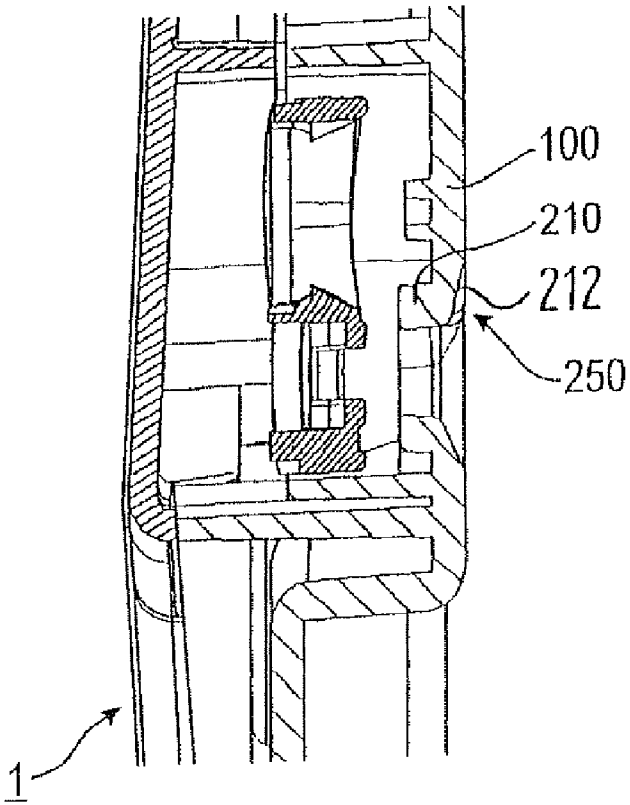
FIG. 11 is a cross-section of the retention mechanism of FIG. 10 without the end plug inserted therein.
Figure 10:
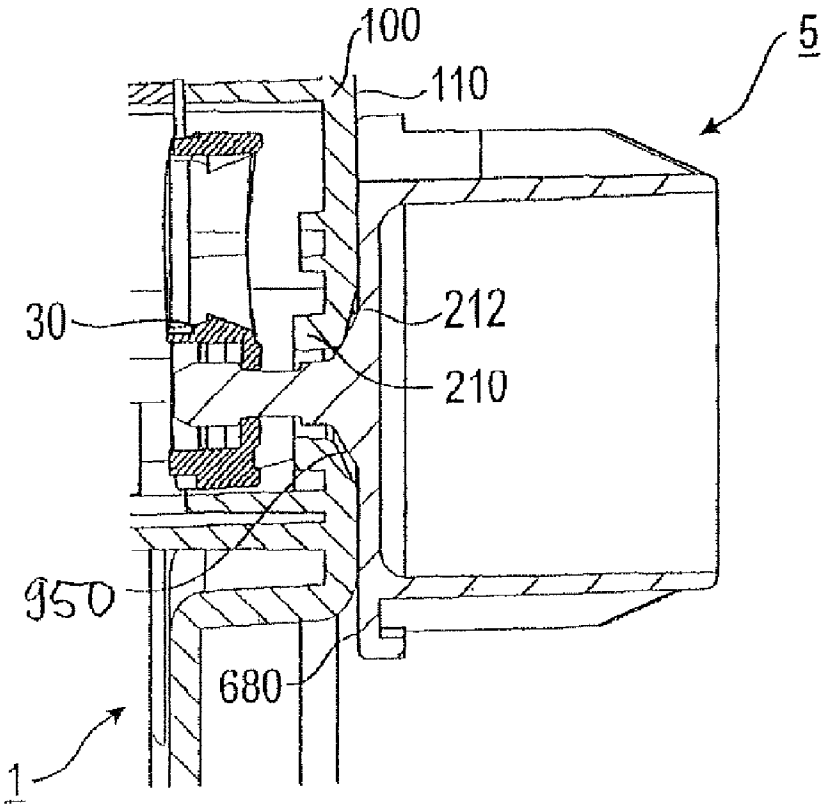
FIG. 10 is a cross-section of the end plug and the retention mechanism in a position of the end plug before sliding past the locking member of the retention mechanism.

FIG. 11 is a cross section through the retention mechanism 1 alone showing the outer wall 100 of the retention mechanism with the upper guide rail 210 whereas the inclination of the inclined portion 212 varies as it extends towards the end position 250 of the retention mechanism.

Figure 12:
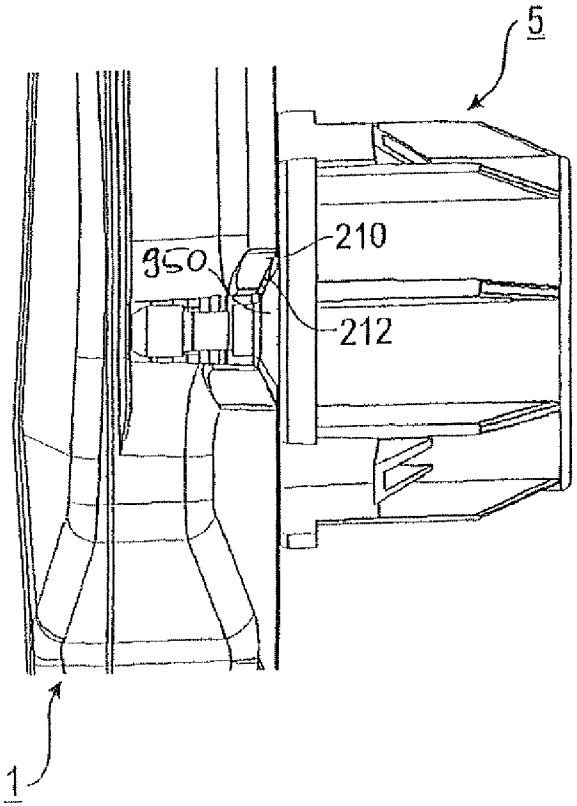
FIG. 12 is a non-sectioned front view of the retention mechanism with the end plug inserted therein in the position shown in FIG. 10.

FIG. 12 shows the end plug 5 in the retention mechanism 1 in a non-sectioned front view, the interaction between the inclined locking portion 950 of the end plug 5 and the upper guide rail 210 and in particular the inclined surface 212 of the upper guide rail 210 being clearly visible.

Figure 13:
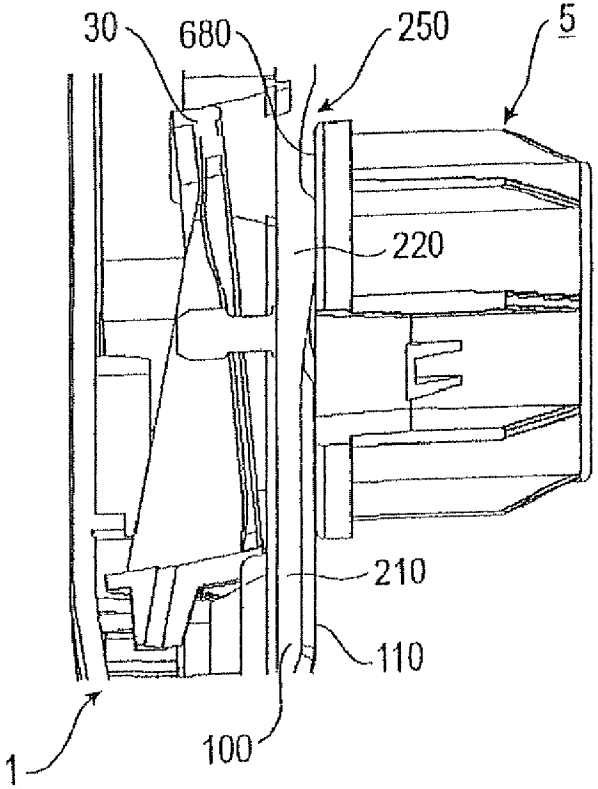
FIG. 13 is a top view of the retention mechanism and the end plug in a position as shown in FIGS. 11 and 12 with parts of the housing of the retention mechanism cut away.

FIG. 13 shows the same position of the end plug 5 in the retention mechanism 1 in a top-view cross section. The end plug 5 moves towards the end position 250. The end position 250 is defined, as will become more apparent in the following drawings, by a locking protrusion 220 which is formed in the upper guide rail 210. The interaction of the upper guide rail 210 and the locking protrusion 220 with the bearing member 70 of the end plug 5 is shown in more detail in FIG. 14.

Figure 14:
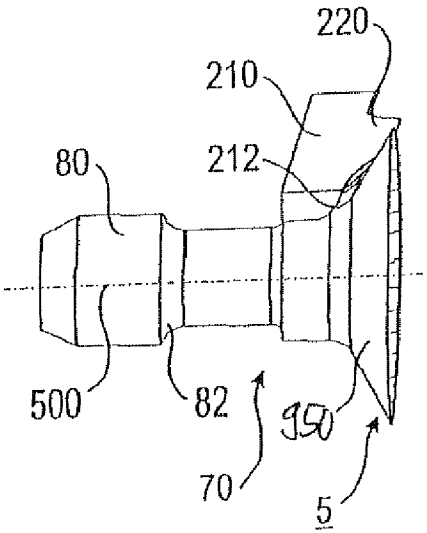
FIG. 14 is an enlarged view of the contact portion between a bearing member of the end plug in interaction with the upper guide rail and the locking member in the insertion slot of the retention mechanism.

FIG. 14 shows the upper guide rail 210 and the locking protrusion 220. The inclined surface 212 of the upper guide rail 210 changes its inclination slightly towards the locking protrusion 220. More important is, however, that the locking protrusion 220 extends in the direction parallel to the longitudinal axis 500 of the bearing pin. Thus, the interaction between the locking protrusion 220 and the end plug 5, in particular between the locking portion 950 and the locking protrusion 220, leads to a movement of the end plug 5 in the direction of the longitudinal axis 500 of the bearing pin 80 such that the end face 680 of the limiting member 68 is lifted off the outer surface 110 of the front wall 100, as will be explained with reference to FIG. 15 below.

In other words, the locking protrusion 220 exerts a force onto the inclined locking portion 950 which moves the end plug 5, in particular the end face 680 of the end plug, in a direction away from the outer surface 110 of the housing 10 of the retention mechanism 1. On the other hand the counter surface 82 of the bearing pin 80 interacts with the counter bracket 30 (not shown in FIG. 14) such that an elastic tension is built up between the locking protrusion 220 and the counter bracket 30.

FIGS. 15 to 18 show the end plug 5 in the retention mechanism 1 in a yet further moved position in which the outer surface 680 of the limiting member 68 of the end plug 5 is lifted off the outer surface 110 of the retention mechanism 1. This is due to the fact that the locking portion 950 of the end plug 5 abuts against the locking protrusion 220 of the upper guide rail 210. The counter bracket 30 is pressed against a portion of the housing 10 by the interaction between the locking portion 950 and the locking protrusion 220 and the counter surface 82 and the counter bracket 30 such that an elastic tension is built up acting on the bearing member 70 of the end plug. In this situation, the insertion force of the end plug 5 into the insertion slot 20 is higher than in the positions described before. In other words, an operator inserting the end plug 5 feels quite a resistance acting against the further insertion of the end plug. In order to overcome this resistance, which is due to the higher friction and the elastic tension, the operator needs to push the end plug 5 harder into the retention mechanism 1. In other words, the operator can feel that the end plug is almost in its end position but is still movable in the insertion direction.

Figure 16:
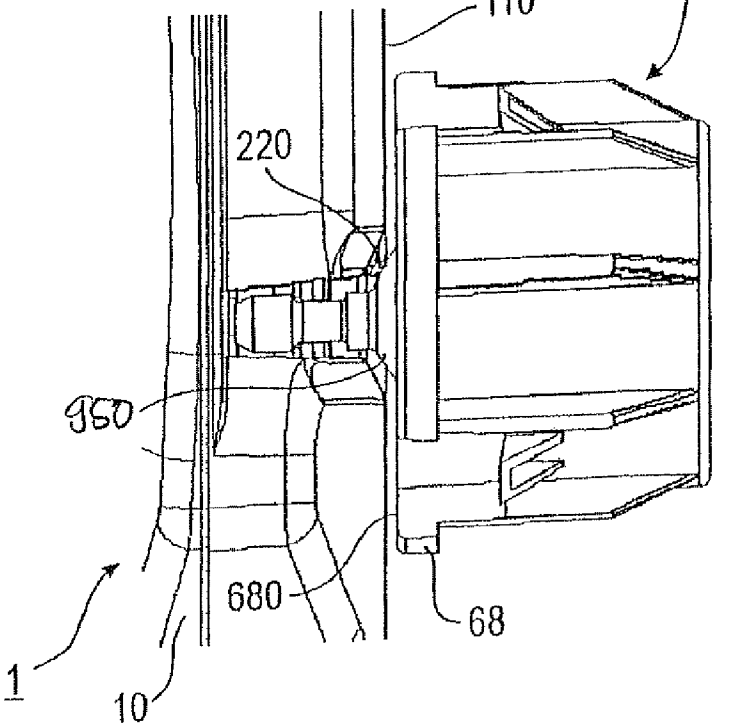
FIG. 16 is a non-sectioned front view of FIG. 15.
Figure 15:
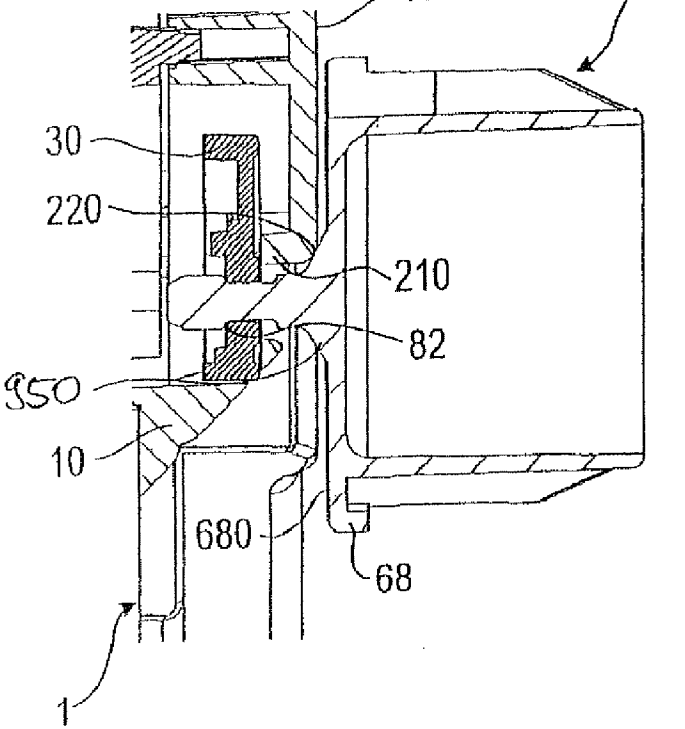
FIG. 15 is a cross-section of the retention mechanism with the end plug inserted therein in a position in which the end plug slides past the locking member of the upper guide rail of the retention mechanism.

FIG. 16 shows the same position of the end plug 5 in the retention mechanism 1 that was shown in FIG. 15 but in a non-sectioned front view. Here, again, it is clearly visible that the front face 680 of the end plug 5 is lifted off the outer surface 110 of the housing 10 of the retention mechanism due to the interaction of the locking protrusion 220 and the locking portion 950 of the end plug.

Figure 17:
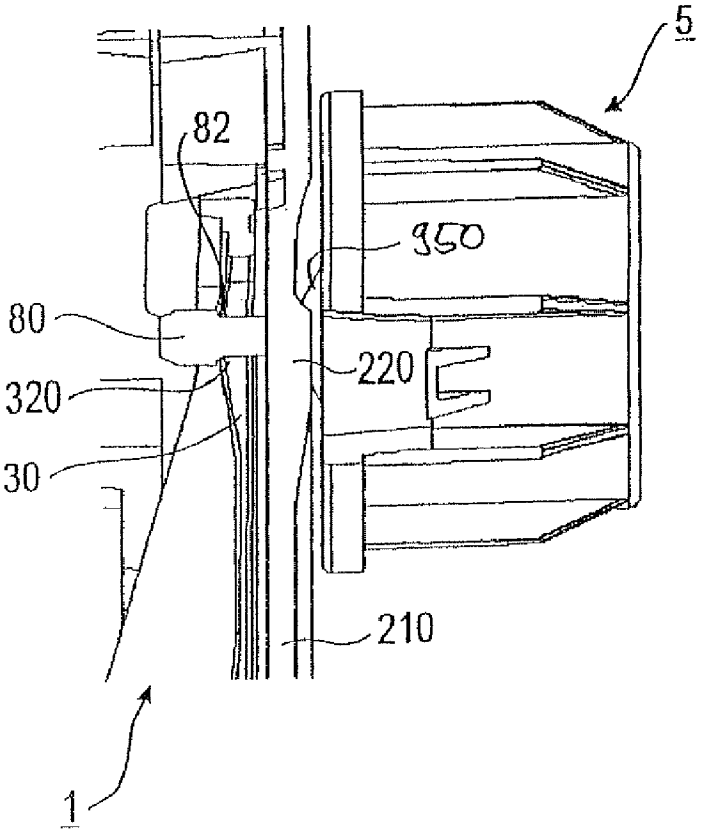
FIG. 17 is a top view of the retention mechanism with the end plug inserted therein in the position shown in FIGS. 15 and 16 with parts of the housing of the retention mechanism being cut away.

FIG. 17 shows the same situation as in FIGS. 15 and 16 but in a top-view with parts of the housing broken away. The upper guide rail 210 and the locking protrusion 220, which interacts with the locking portion 950 of the bearing member 70 is shown.

It is to be noted that the counter bracket 30 also comprises locking protrusions 320 which extend in a direction opposite to that of the locking protrusion 220 of the upper guide rail 210. The locking protrusions 320 of the counter bracket 30 interact with the counter surface 82 of the bearing pin 80 of the end plug 5. Consequently, the distance between the counter surface 82 of the bearing pin 80 and the contact area of the upper guide rail 210 with the locking portion 950 of the end plug 5 is increased such that an elastic tension is built up between these two facing surfaces. The dimensions of the locking protrusion 220 of the upper guide rail 210 and the locking protrusion 320 the counter bracket 30 are balanced such that the end plug 5 can be slid into its end position over the locking protrusions 220, 320 with a pushing force that is not unduly high.

Figure 18:
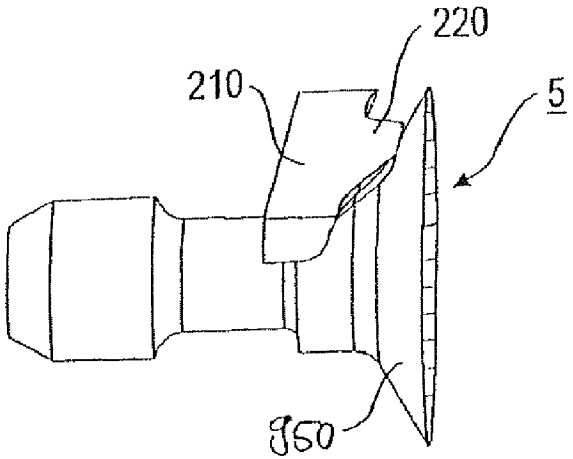
FIG. 18 is an enlargement of the contact portion between the bearing member of the end plug in interaction with the upper guide rail and the locking member in the insertion slot of the retention mechanism.

FIG. 18 shows, in an enlarged view, the interaction of the locking portion 950 of the end plug 5 with the locking protrusion 220 of the upper guide rail 210 in the position of the end plug 5 in the retention mechanism 1, as it is shown in FIG. 17.

FIGS. 19 to 24 show the end plug 5 in its end position in the retention mechanism 1. The end face 680 abuts against the outer surface 110 of the housing 10 again. In other words, the end plug 5 has overcome the locking protrusions 220, 320 that were discussed in FIG. 17 and has moved back into a position abutting against the housing 10 of the retention mechanism 1.

Figure 20:
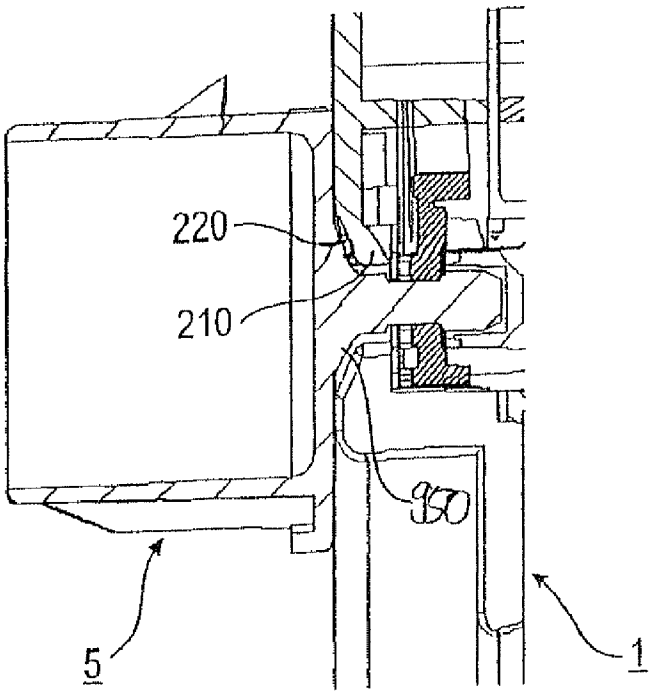
FIG. 20 is a back view cross-sectional of the retention mechanism and the end plug of FIG. 19.
Figure 19:
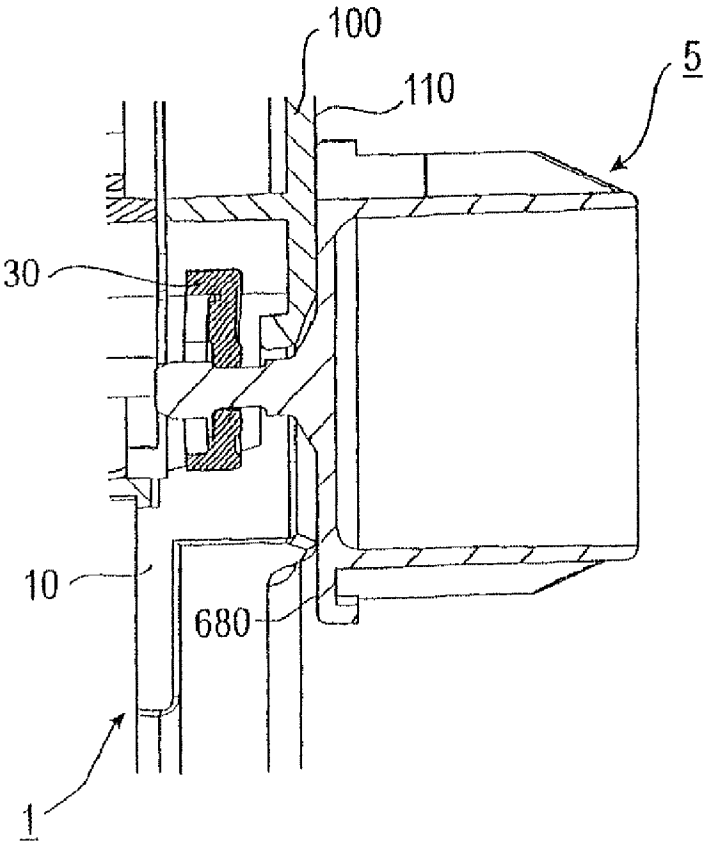
FIG. 19 is a front view cross-section of the retention mechanism with the end plug inserted therein its end position.

The counter bracket 30 has sprung back into a position where it is parallel to the outer wall 100 of the retention mechanism 1. FIG. 19 shows the cross section of the end plug 5 in the retention mechanism 1 in a cross section front view. FIG. 20 shows the end plug 5 in the retention mechanism 1 in the same position of the end plug in a back side view. In this back side view, the locking protrusion 220 of the upper guide rail 210 is visible that interacts with the locking portion 950 of the end plug 5 and prohibits the end plug 5 from exiting the end position.

Figure 21:
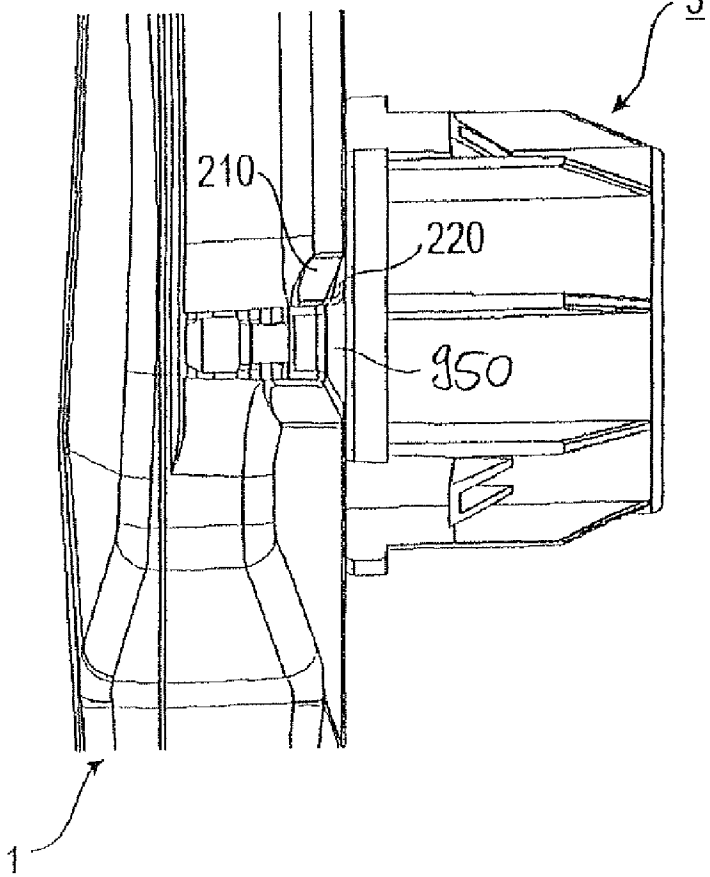
FIG. 21 is a non-sectioned front view of the retention mechanism and the end plug in the position shown in FIGS. 19 and 20.

This same position of the end plug 5 in the retention mechanism 1 is also shown in a non-sectioned front view in FIG. 21. Here, it is clearly becomes apparent that a part of the locking portion 950 is "hidden" behind the locking protrusion 220 of the upper guide rail 210 and, thus, locks the end plug 5 in its end position.

Figure 22:
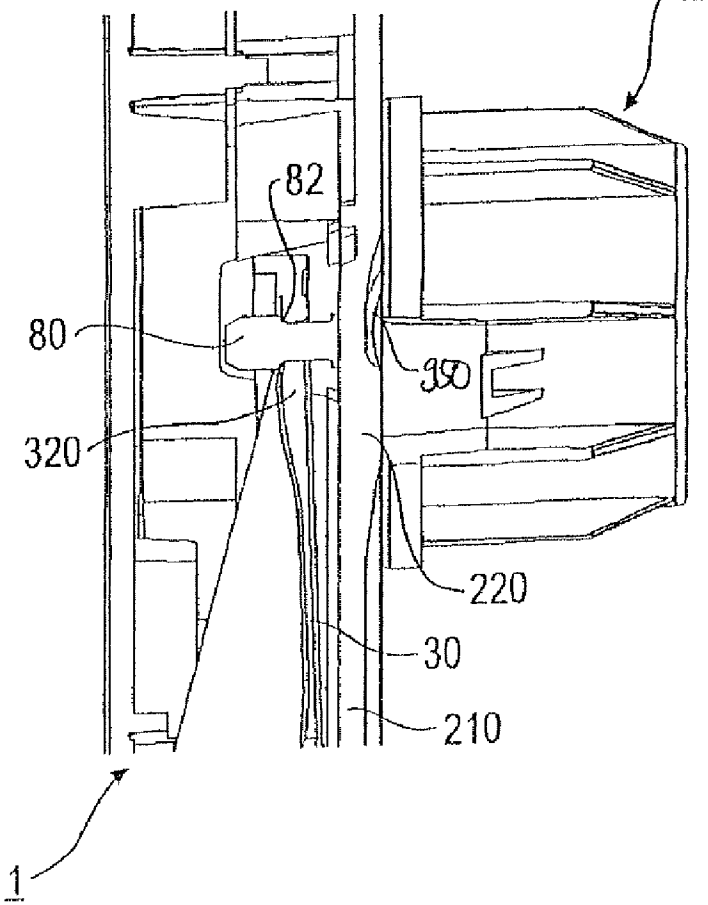
FIG. 22 is a top view of the end plug inserted in its end position in the retention mechanism, as shown in FIGS. 19 to 21, the housing of the retention mechanism being partly broken away.

FIG. 22 shows the end plug 5 in the retention mechanism 1 in a top view with parts of the housing cut away. The locking protrusion 220 of the upper guide rail 210 keeps the end plug 5 via interaction with the locking portion 950 in its end position. Furthermore, the interaction of the counter surface 82 of the bearing pin 80 with the locking protrusion 320 of the counter bracket 30 also keeps the end plug in the end position.

Figure 23:
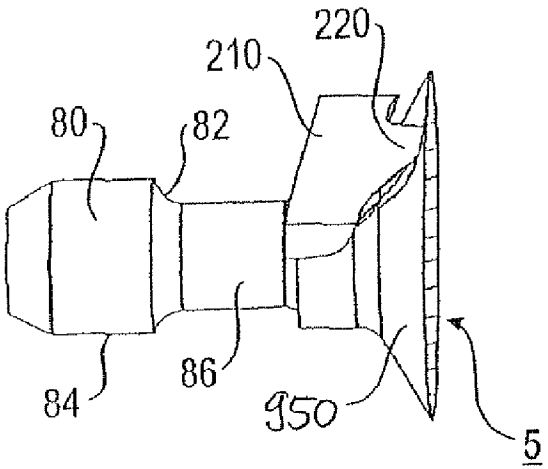
FIG. 23 is an enlarged view showing the interaction between the bearing portion of the end plug and the upper guide rail of the insertion slot with the end plug in its end position.

FIG. 23 shows the interaction of the upper guide rail 210 with the locking protrusion 220 and the locking portion 950 of the end plug 5. It has to be noted that the locking protrusion 220 is asymmetric. This asymmetric shape is formed such that, in the insertion direction, the locking protrusion 220 has a smoother slope than in the removal direction. In other words, the widest portion of the locking protrusion 220 is reached in the insertion direction over a longer distance than in the opposite direction. This leads to a situation in which the end plug 5 is firmly held in the end position and a locking force of 18N to 19N is exerted onto the end plug 5.

Figure 24:
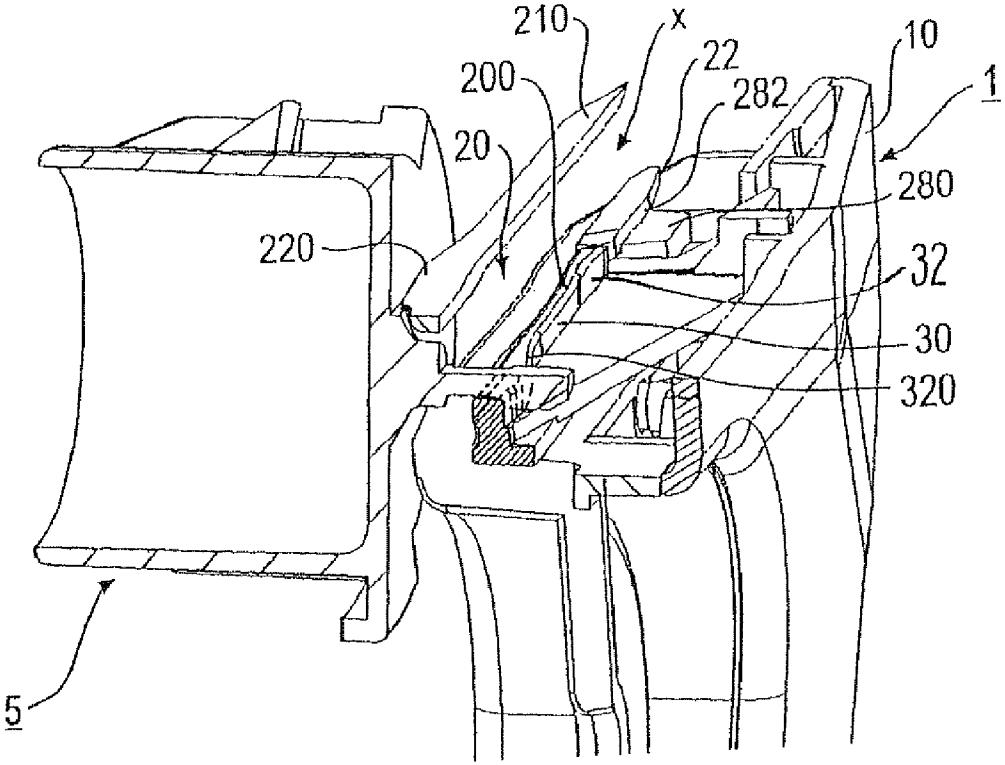
FIG. 24 is a perspective cross-section showing the end plug in its end position within the retention mechanism.

FIG. 24 shows the end plug 5 and the retention mechanism 1 in a perspective cross section. Lower rail 200 and upper rail 210 of the insertion slot 20 are shown. In the upper rail, the locking protrusion 220 is also shown. The counter bracket 30 which is pivotable about pivoting axis 32 is shown as well as the locking protrusion 320 of the counter bracket 30.

Figures 31, 32, 33, 34, 35:
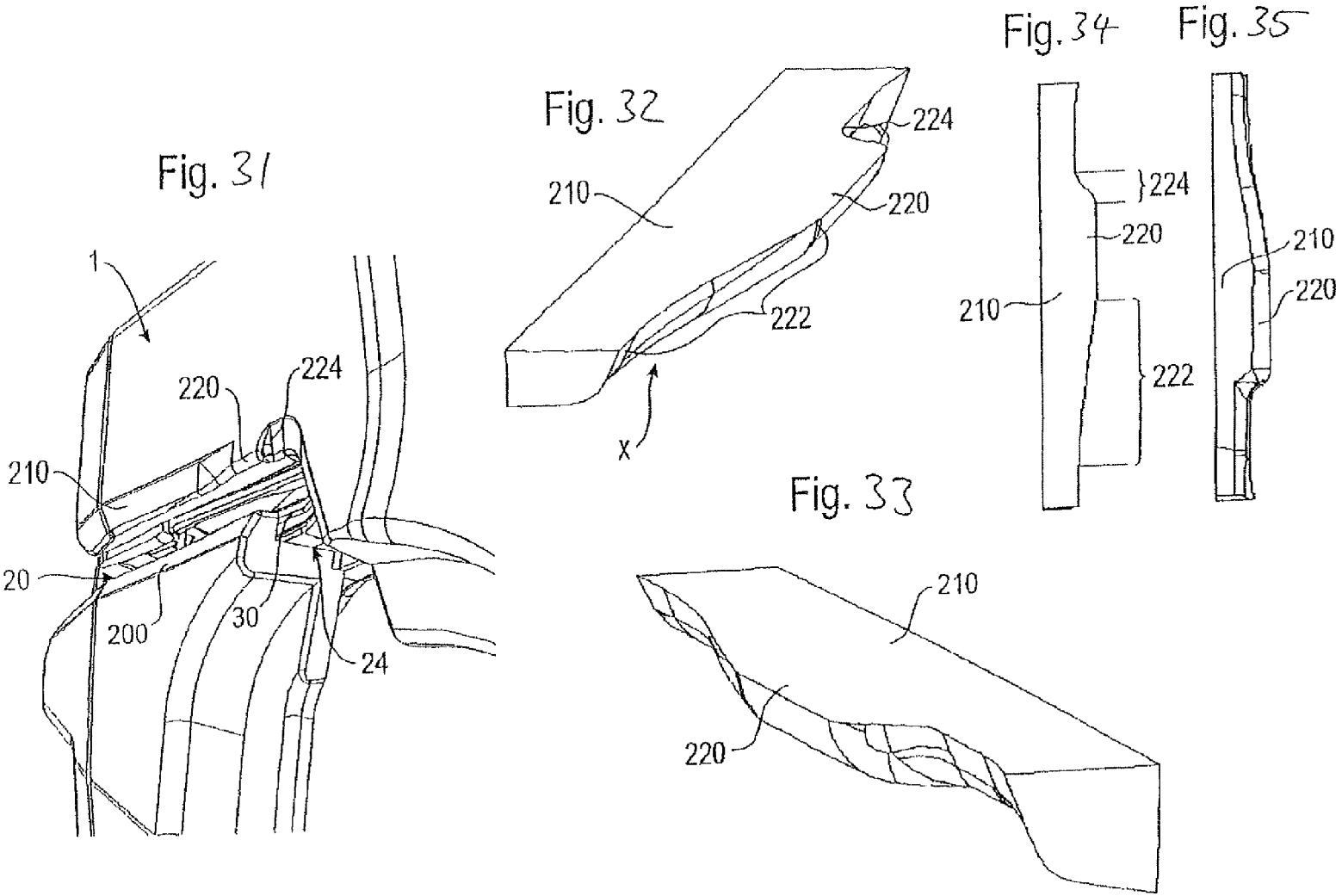
FIG. 31 is a perspective view of the housing of the retention mechanism.
FIG. 32 is a perspective view of the upper guide rail of the insertion slot in a front view.
FIG. 33 is a perspective view of the back side of the upper guide rail of the insertion slot.
FIG. 34 is a top view of the upper guide rail of the insertion slot.
FIG. 35 is a bottom view of the upper guide rail of the insertion slot.

The insertion slot 20 is formed between the lower guide rail 200 and the upper guide rail 210. At the entrance section 22 of the insertion slot 20, a prevention section comprising a first prevention member 280 and a second prevention member 282 is situated. The prevention members 280, 282 are formed such that only an end plug 5 with a bearing pin 80 of the correct dimensions can be inserted into the insertion slot 20. To achieve this, the first prevention member 280 ensures that the outer diameter of the first portion 84 of the end plug 80 has a correct outer diameter. If the outer diameter of the first portion 84 of the end plug is too large, the bearing pin 80 cannot pass through this first prevention member 280 of the prevention section. A second prevention member 282 of the prevention section ensures that the second portion 86 of the bearing pin 80 of the end plug has the correct outer diameter. If the outer diameter of the second portion 86 of the bearing pin is too large, the bearing pin cannot slide past this second prevention member 282 of the prevention section. A third prevention mechanism is present in the counter bracket 30 in that the guiding slit in the counter bracket 30 is dimensioned such that only a bearing pin with the correct outer diameters can be held in the counter bracket 30. In particular, the guiding slit in the counter bracket 30 has dimensions such that a bearing pin with a too large diameter of the second portion 86 of the bearing pin cannot be inserted into the guiding slit. Furthermore, if the first portion 84 of the bearing pin 80 is too small, a locking portion 82 of the bearing pin 80 cannot come into contact with the rails forming the guiding slit in the counter bracket 30 and the counter bracket 30 will not be pivoted towards the outer wall of the housing 10. Subsequently, a bearing pin with a counter surface 82 of the wrong dimension will fall off the retention mechanism through an exit section 24 of the insertion slot 20, as can be seen in FIG. 31. Such a bearing pin of incorrect dimensions would, consequently, be rejected by the retention mechanism 1.

Figure 25:
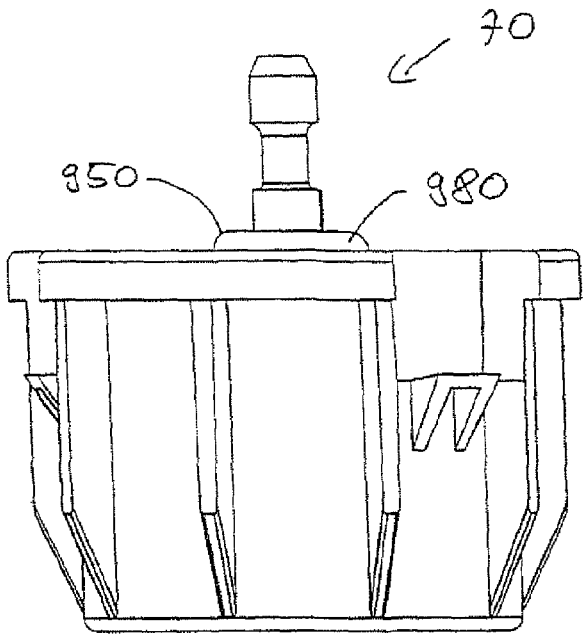
FIG. 25 is a perspective side view and an enlarged sectional view of an end plug with a ring-shaped structure that defines a locking portion.
Figure 25:
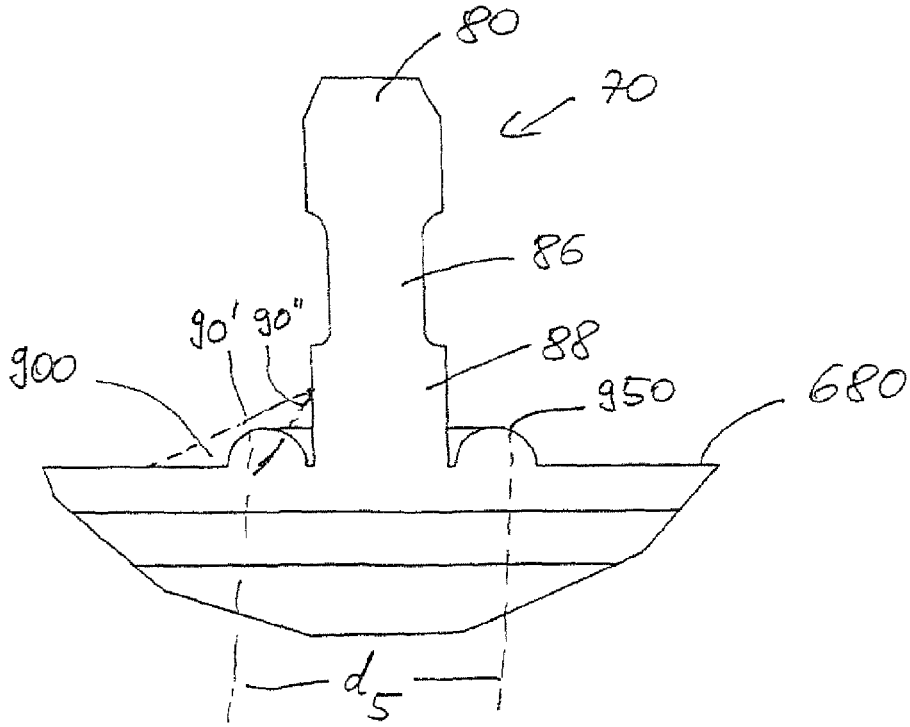

In FIG. 25, another alternative of the end plug is shown in a perspective side view and an enlarged sectional view of its bearing member 70. The locking portion 950 is defined by a ring-shaped structure 980 that extends around the third portion 88 of the bearing pin 80. It will be appreciated that the locking portion 950 has at least one diameter $d_5$ which is larger than the third outer diameter $d_3$ of the third portion 88 of the bearing pin 80.

Furthermore, the first surface 90' and the second surface 90" are shown schematically in order to illustrate that the locking portion 950 is positioned within the zone 900 and, accordingly, between the first surface 90' and the second surface 90". It will also be appreciated that the ring-shaped structure 980 is generally situated closer to the end face 680 than the second portion 86 of the bearing pin 80. As can be seen in the Figure, the summit sections of the ring-shaped structure 980 basically define the locking portion 950.

Figure 26:
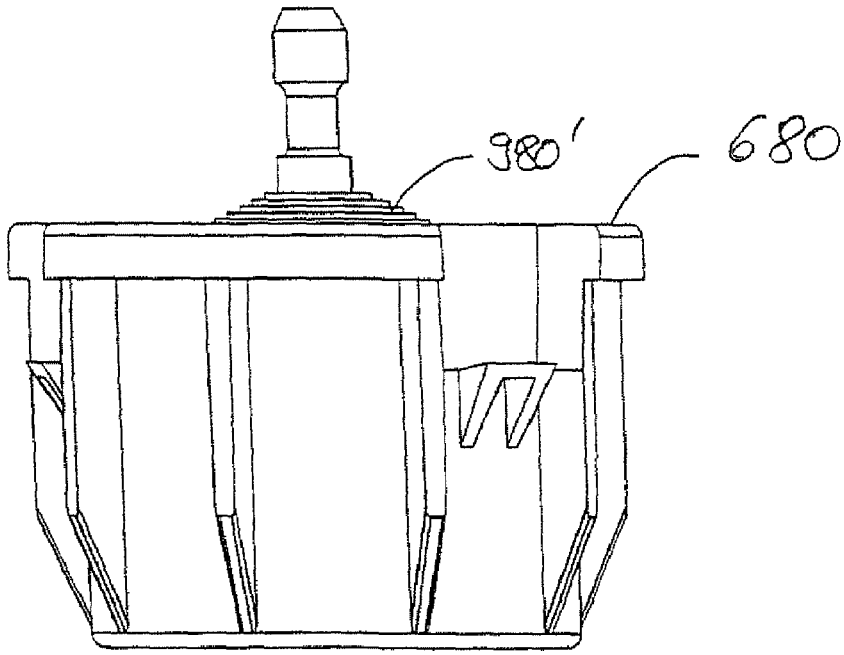
FIG. 26 is a perspective side view and an enlarged side view of an end plug with a stepped structure that defines a locking portion.
Figure 26:
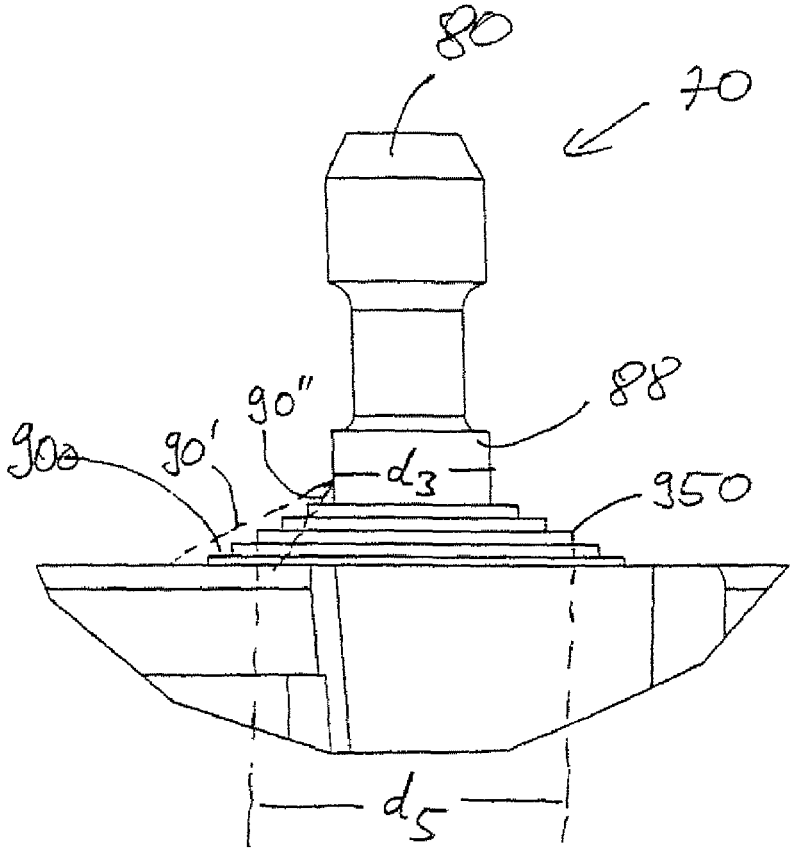

In a further alternative that is shown in FIG. 26, the end plug is provided with a stepped structure 980' which defines at least one locking portion 950. It will be appreciated that the locking portions 950 are basically defined by the corner portions of the stepped structure 980'.

In the enlarged perspective side view of the bearing member 70, the first surface 90' and the second surface 90" are schematically shown in order to illustrate that the locking portions 950 are situated in a zone 900 between the first surface 90' and the second surface 90". It will also be appreciated that the stepped structure 980' is situated closer to the end face 680 than the third portion 88 of the bearing pin 80. In addition to that, it is immediately apparent from the Figure that the locking portion 950 has at least one outer diameter $d_5$ that is larger than the outer diameter $d_3$ of the third portion 88 of the bearing pin 80.

Figure 27:
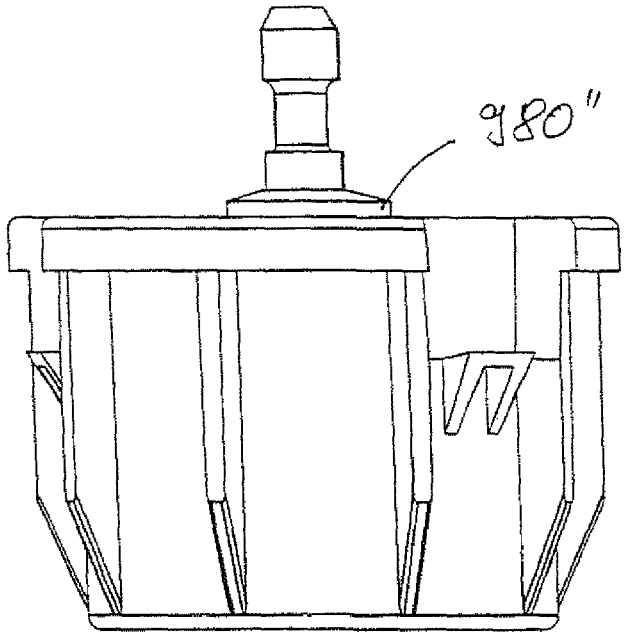
FIG. 27 is a perspective side view and an enlarged side view of an end plug with a chamfered structure that defines a locking portion.
Figure 27:
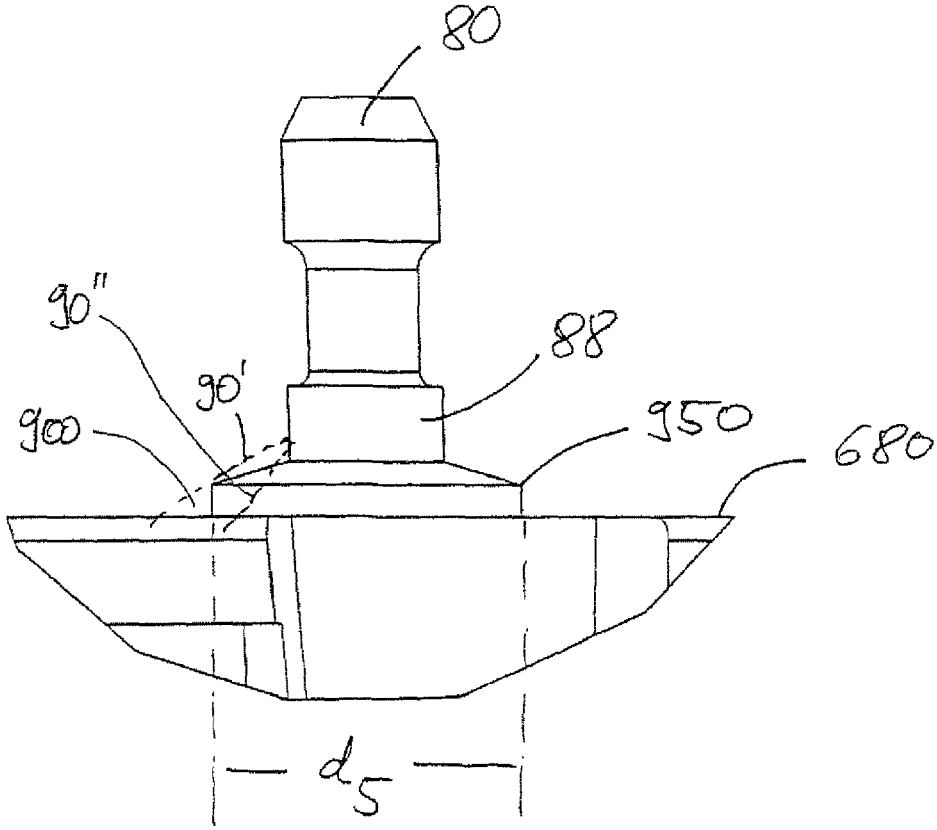

FIG. 27 shows yet another embodiment of the end plug with a chamfered structure 980" that defines at least one locking portion 950. As in FIGS. 26 and 27, it is schematically shown that the locking portion 950 is positioned in a zone 900 between the first surface 90' and the second surface 90". Furthermore, the chamfered structure 980" sits closer to the end face 680 than the third portion 88 of the bearing pin 80.

Figure 28:
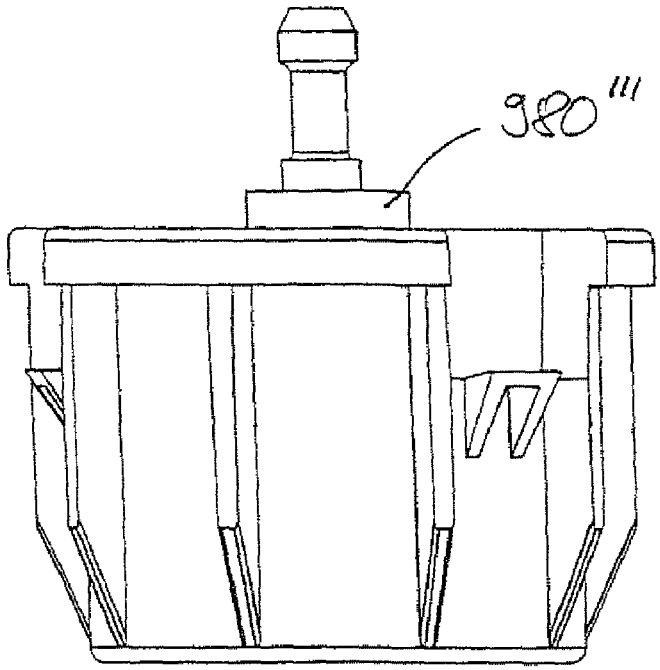
FIG. 28 is a perspective side view and an enlarged side view of an end plug with a cylindrical structure that defines a locking portion.
Figure 28:
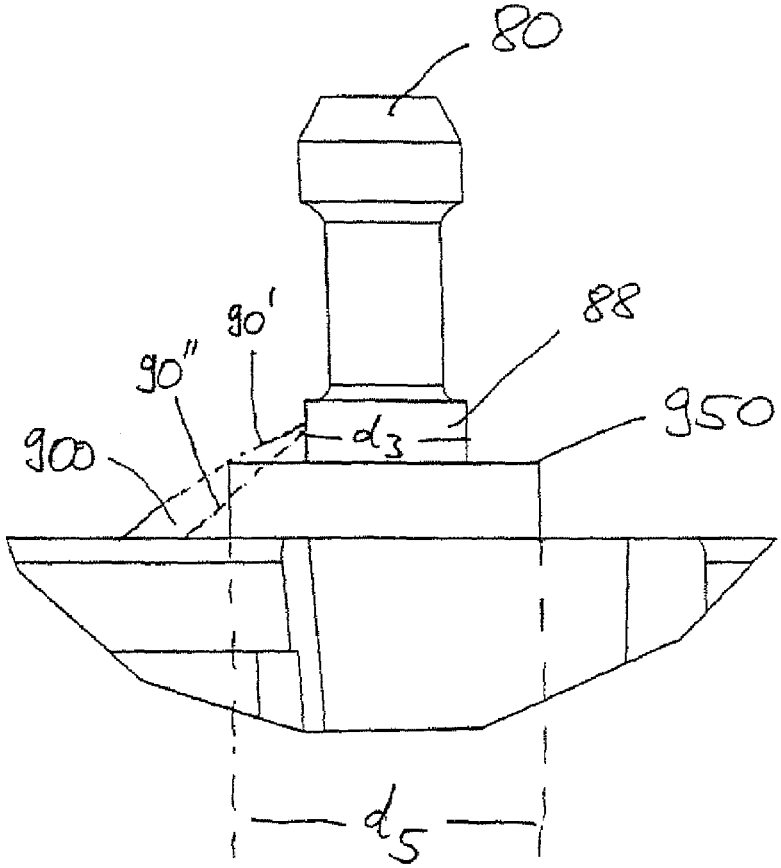

In another embodiment of the end plug which is shown in FIG. 28, a basically cylindrical structure 980'" is provided that defines at least one locking portion 950. Here, again, the first surface 90' and the second surface 90" are schematically shown that define the zone 900 in which the locking portion 950 is positioned. Furthermore, it is immediately apparent that the outer diameter $d_5$ of the cylindrical portion 980'" which defines the locking portion 950 has a larger diameter than the diameter $d_3$ of the third portion 88 of the bearing pin 80.

Figure 29:
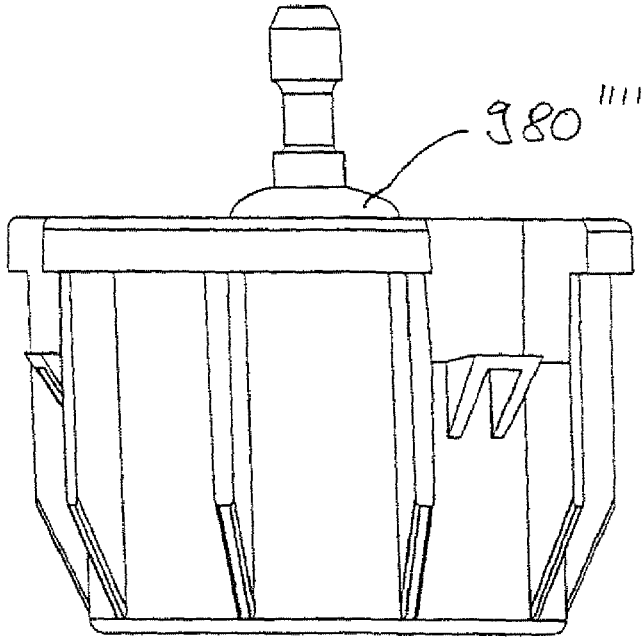
FIG. 29 is a perspective side view and an enlarged side view of an end plug with a hemispherical structure that defines a locking portion.
Figure 29:
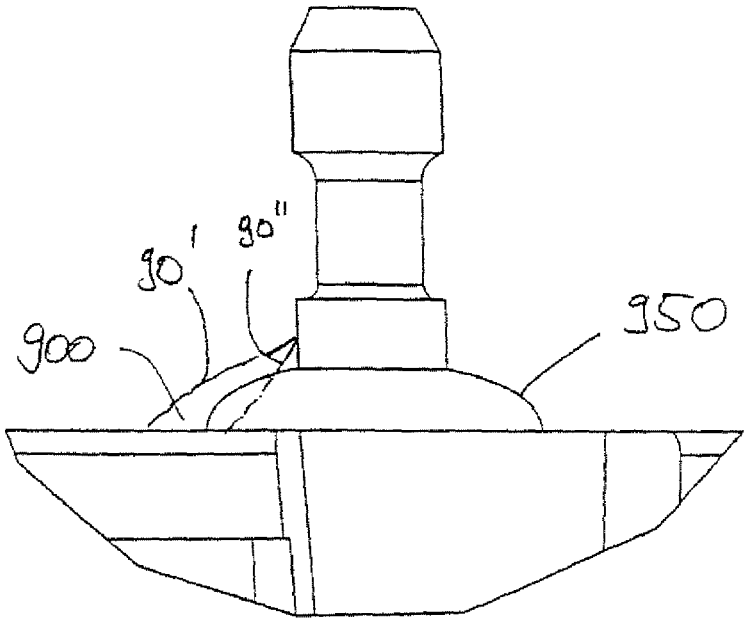

FIG. 29 shows yet another embodiment of the end plug. In this embodiment, a basically hemispherical structure 980"" is provided which basically defines at least one locking portion 950. Here, again, the locking portion 950 is positioned in a zone 900 defined by the first surface 90' and the second surface 90". The locking portion 950 is preferably defined by at least one tangential portion on the hemispherical structure 980"".

Figure 30:
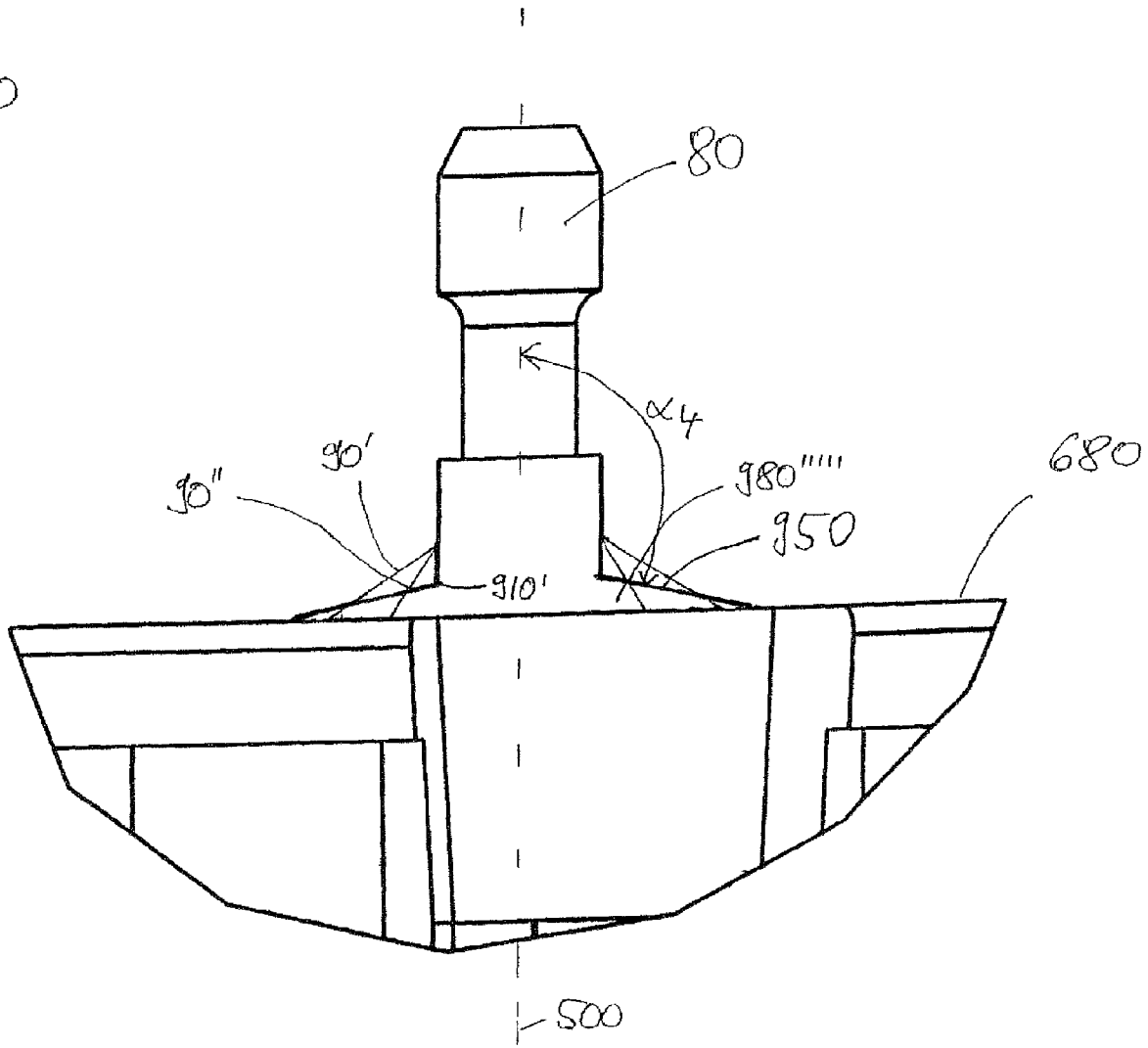
FIG. 30 is a perspective view of an end plug with a conical structure defining the locking portion.

FIG. 30 shows yet another embodiment of an end plug to be locked in the retention mechanism 1. The end plug of FIG. 30 shows a truncated cone structure 980'"' that defines at least one locking portion 950. The truncated cone structure 980'"' differs from the truncated cones shown in FIGS. 2 to 6 in that the intersection position 910' between the surface of the truncated cone structure 980'"' and the bearing pin 80 is spaced apart from the end face 680 by less than 2 mm. Accordingly, the angle $\alpha_4$ between the surface of the truncated cone structure 980'"' and the longitudinal axis 500 of the bearing pin 80 is less than 117°. However, at least one locking portion 950 is positioned within the zone 900 that is defined by the first surface 90' and the second surface 90". The locking portion 950 carries the locking forces even if its angle is less than 117°.

FIGS. 31 to 35 show the upper guide rail 210 of the retention mechanism 1 in different views and perspectives. The locking protrusion 220 has, in the insertion direction X, a smoother slope than in the opposite direction. In particular, the section 222 extends over a longer distance than the section 224. An end plug inserted into the retention mechanism will, consequently, be locked with its locking portion 950 behind the steeper section 224.

It has been found that the interaction between the inclined locking portion 950 of the bearing member of the end plug with the specific form of the locking protrusion 220 leads to an improved handling of the insertion of the end plug into the retention mechanism. In particular, the end plug can be slid into the end position easily due to the interaction of the inclined surface with the smoother sloped portion 222 of the locking protrusion 220. The end plug snaps then into its end position and sits there firmly whereas the interaction between the inclined locking portion of the end plug and the steeper sloped portion 224 of the locking protrusion 220 results in a locking force of 18N to 19N. This particular locking force has been found to be advantageous since it keeps the end plug and the tissue paper roll mounted on the end plug in a fixed position during use but allows, on the other hand, easy replacement of the tissue roll by simply pulling the tissue roll out in a direction opposite to the insertion direction. Thus, the removal process substantially works in the same way as the insertion but backwards.

FIGS. 36 to 39 show, once more, the insertion process of the end plug 5 into the retention mechanism in different perspective.

Figure 36:
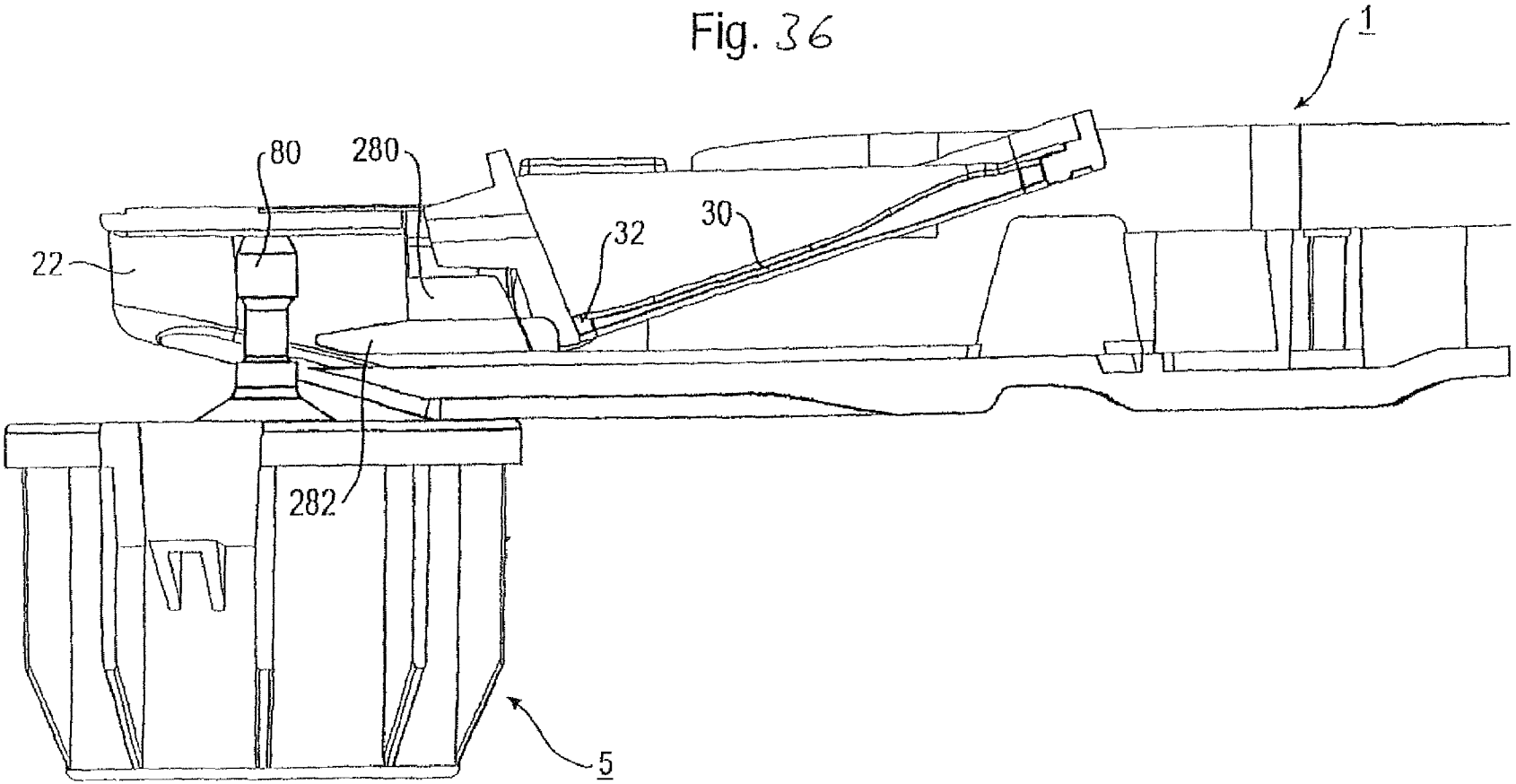
FIG. 36 shows the retention mechanism with an end plug inserted therein in a first position of the end plug in a top view with parts of the housing of the retention mechanism being cut away.

FIG. 36 is a top view showing the end plug and the retention mechanism 1 with parts of the housing of the retention mechanism 1 broken away. The end plug 5 is shown in a position before actually entering the insertion slot. The bearing pin 80 sits in an entrance section 22 of the insertion slot. The prevention members 282 and 280 that were described with regard to FIG. 23, are shown. Furthermore, the counter bracket 30 is shown in an insertion position pivoted about pivoting axis 32.

Figure 37:
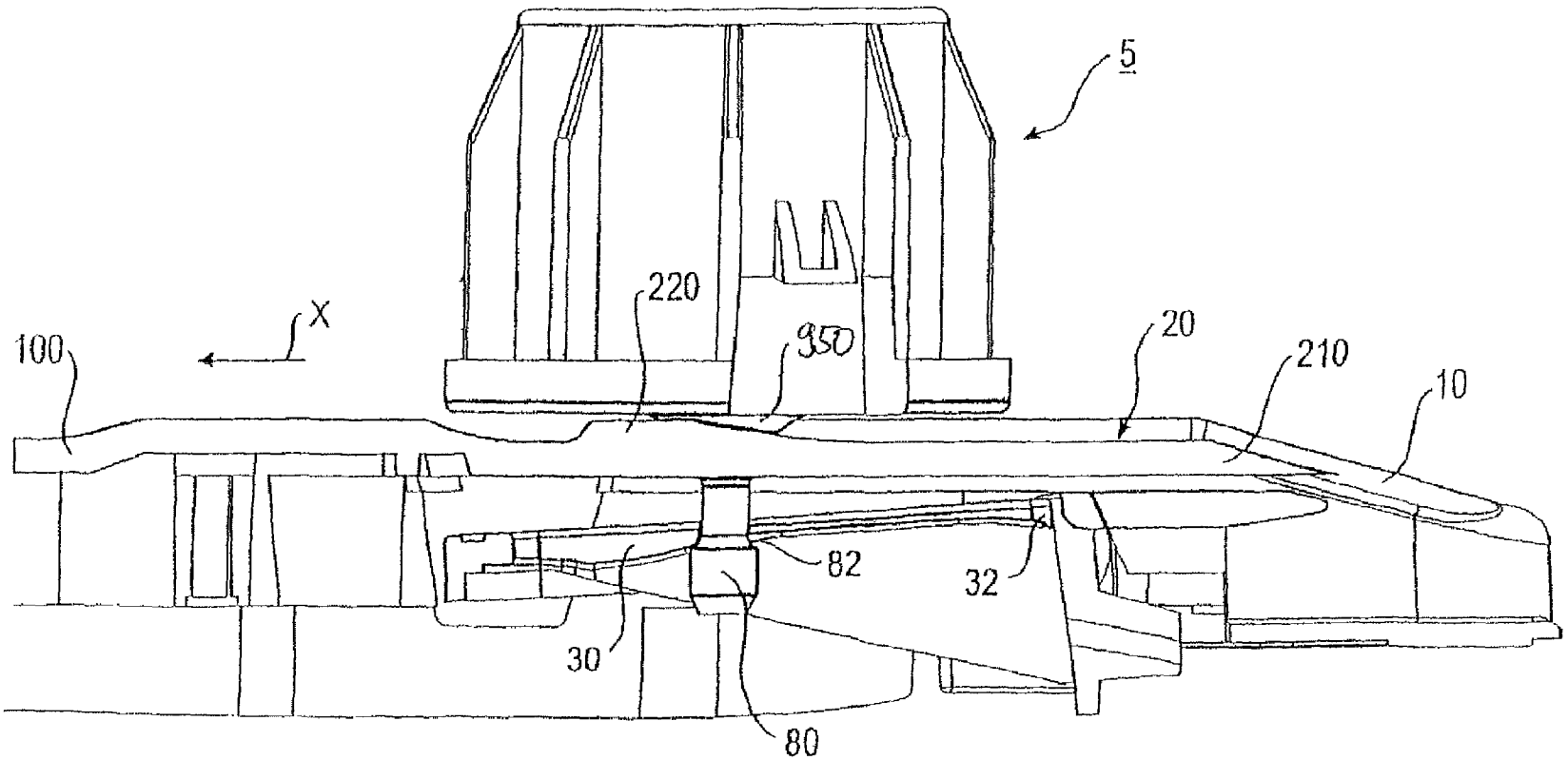
FIG. 37 shows the end plug inserted into the retention mechanism, as in FIG. 36, in a second position.

FIG. 37 shows the end plug 5 in a position slid into the insertion slot in the insertion direction X. The counter surface 82 of the bearing pin 80 interacts with the counter bracket 30 such that the counter bracket 30 is pivoted about the pivoting axis 32 towards the outer wall 100 of the housing 10. The locking portion 950 of the end plug 5 has already started to interact with the locking protrusion 220 of the upper guide rail 210.

Figure 38:
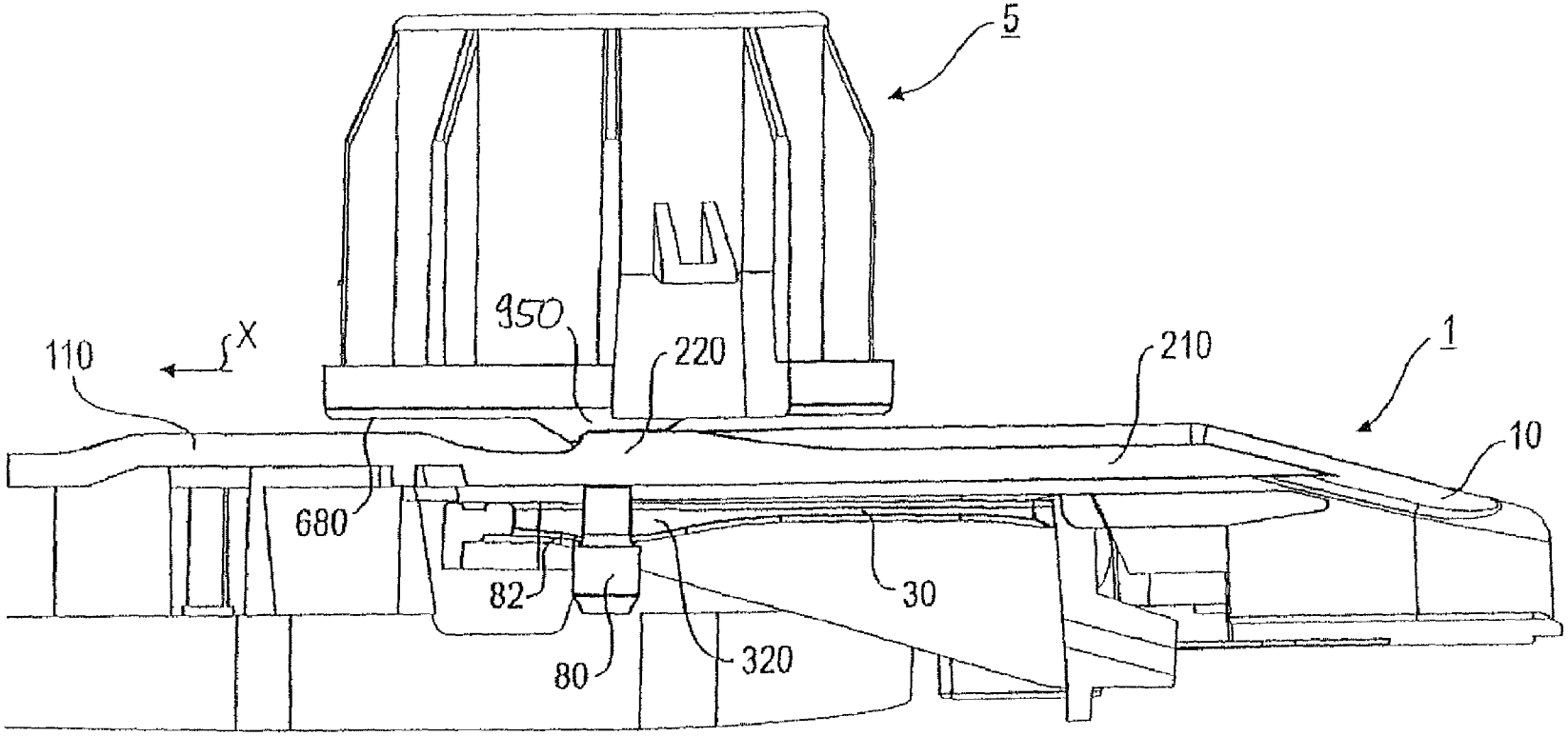
FIG. 38 shows the end plug in the retention mechanism, as in FIGS. 36 and 37, in a third position.

FIG. 38 shows the end plug 5 in the retention mechanism 1 in a third position in which the locking portion 950 of the end plug 5 interacts with the locking protrusion 220 of the upper guide rail 210 such that the end face 680 of the end plug 5 is lifted off the outer surface 110 of the housing 10. The counter surface 82 of the bearing pin 80 also interacts with the locking protrusion 320 of the counter bracket 30 such that an elastic tension is built up between the locking portion 950 and the counter surface 82 by slight deformation of the counter bracket 30 and/or by moving the counter bracket 30 beyond its locking position in a position in which it exerts more tension onto the counter surface 82.

Figure 39:
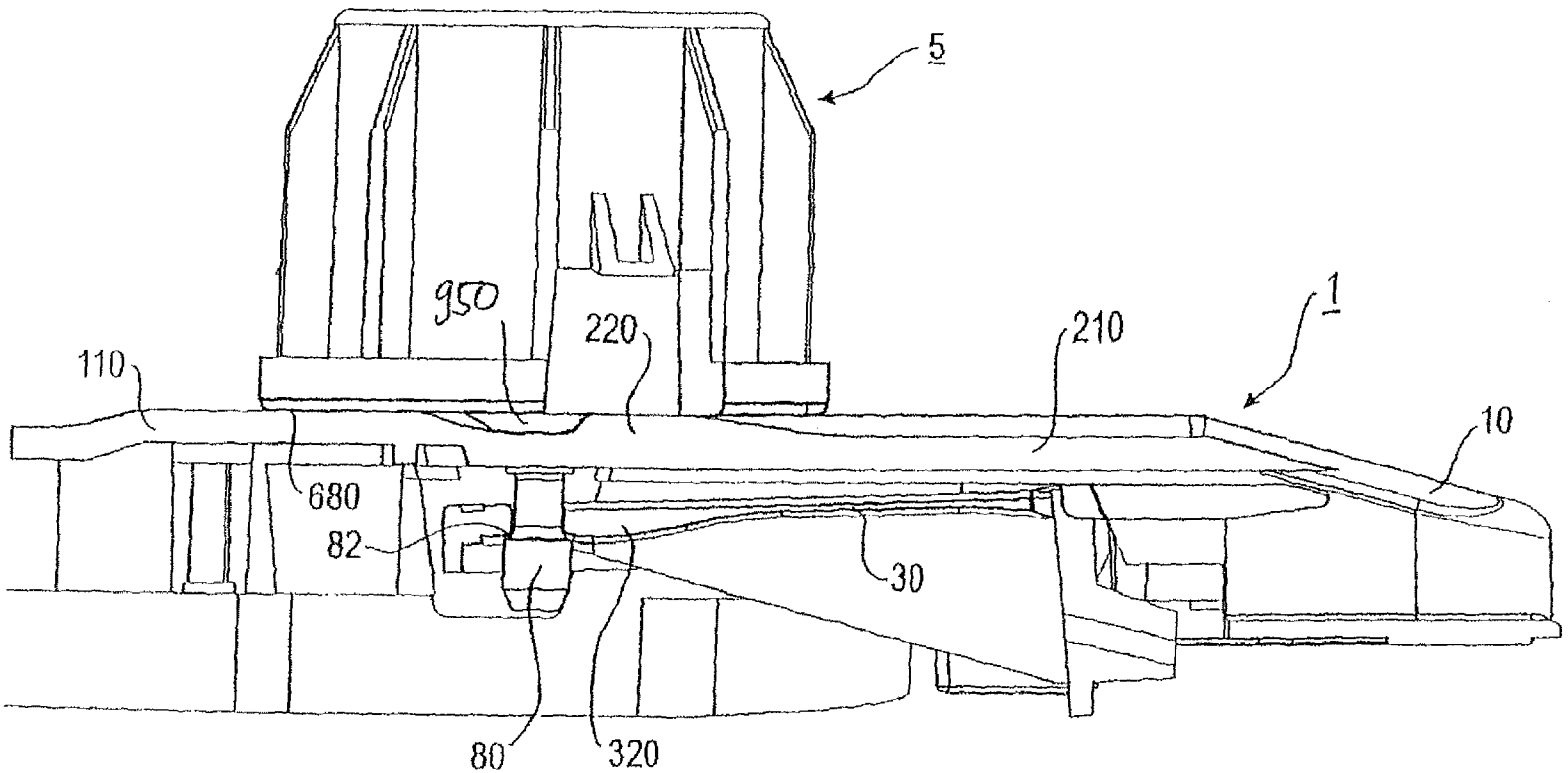
FIG. 39 shows the end plug in an end position in the retention mechanism as shown in FIGS. 36 to 38.

FIG. 39 shows the end plug 5 in its end position in the retention mechanism 1. The end face 680 abuts against the outer surface 110 of the housing 10 and the locking portion 950 of the end plug 5 is slid beyond the locking protrusion 220 of the upper guide rail 210. The counter surface 82 of the bearing pin 80 is also moved beyond the locking protrusion 320 of the counter bracket 30. Consequently, the counter bracket 30 sprung back into its end position, as can be clearly seen by comparing the orientation of the counter bracket 30 in FIGS. 31 and 32. The end plug 5 sits, in this position, firmly in the end position by the interaction of the locking portion 950 of the end plug 5 with the locking protrusion 220.

Figure 40:
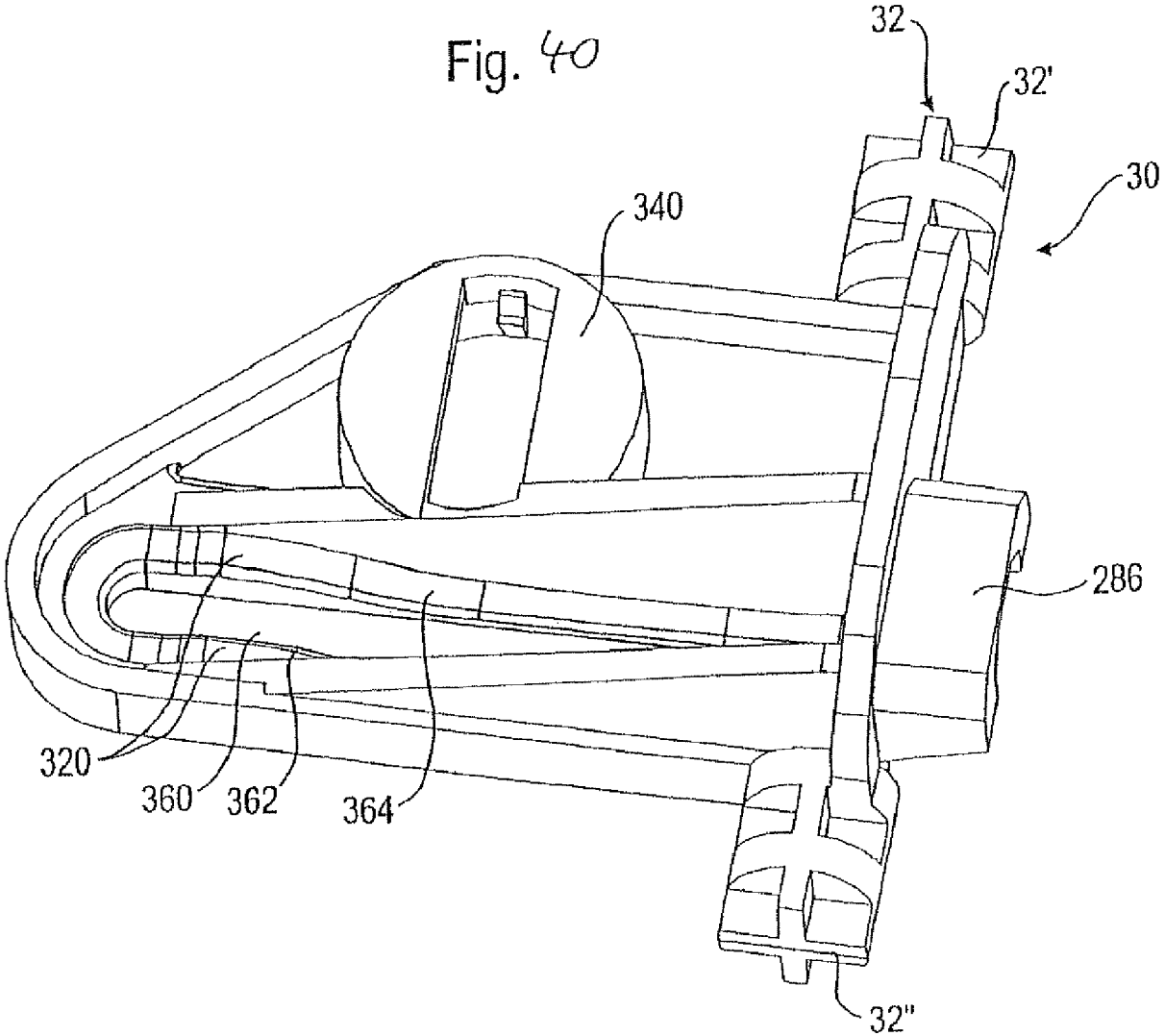
FIG. 40 shows the counter bracket in a perspective view.

FIG. 40 shows the counter bracket 30 in a perspective view. The counter bracket 30 is pivotable about a pivoting axis 32 which is formed by pivoting members 32' and 32". The counter bracket 30 has a guiding slit 360 which is formed by a lower guide rail 362 and an upper guide rail 364. The guiding slit 360 has dimensions to interact with the counter surface 82 of the bearing pin 80, as shown in the previous Figures. In other words, the guiding slit 360 has a width that fits the lower diameter of the second portion 86 of the bearing pin and is able to interact with the counter surface 82. A locking protrusion 320 is formed in the lower guide rail 362 and in the upper guide rail 364. The locking protrusion 320 has a smooth section leading to its widest portion which is situated in the insertion direction and a steeper portion which is situated in the opposite direction.

The guiding bracket 30, furthermore, includes a spring support 340 for accommodating a spring 34, as it is shown in FIG. 1.

A fourth prevention member 286 is provided downstream of the guiding slid 360 in the form of a hood that prevents the insertion of a guiding pin 80 of a end plug 5 that is too long. Such too long guiding pin would, consequently, be rejected by the third prevention portion 286.

Figure 41:
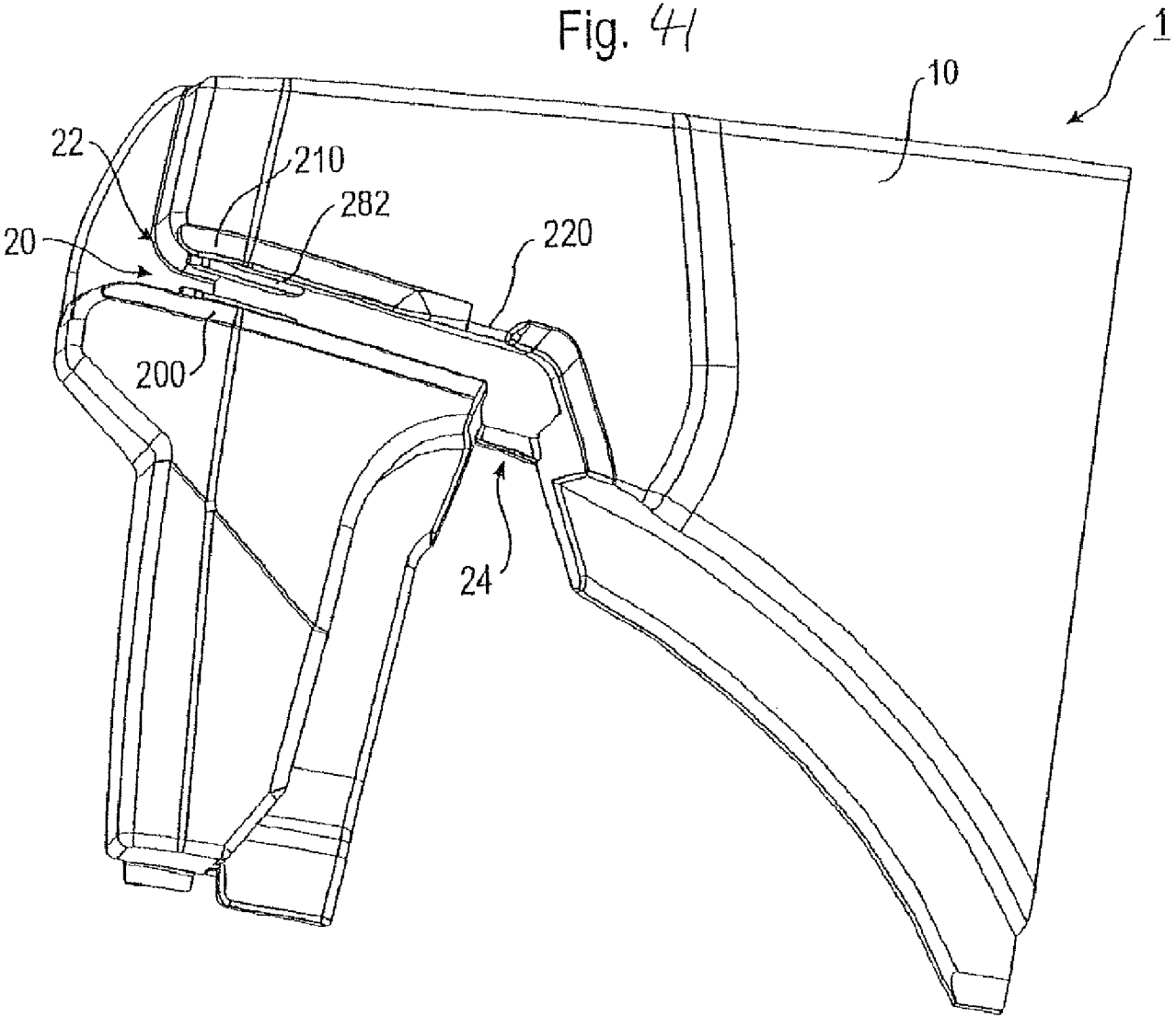
FIG. 41 shows the housing of the retention mechanism in a perspective view.

FIG. 41 shows a perspective view of the housing 10 of the retention mechanism 1. The insertion slot 20, which is formed by the lower guide rail 200 and the upper guide rail 210, is clearly visible. The upper guide rail 210 has the locking protrusion 220 formed therein. The insertion slot 20 has an entrance section 22 and an exit section 24. The exit section 24 serves to reject bearing pins of incorrect dimensions. In particular bearing pins that have too small dimensions fall off the insertion slot 20 through the exit section 24. FIG. 41 also shows that the prevention members 280 and 282 are also present on the upper side of the insertion slot 20.

The invention claimed is:

1. An end plug for a roll of material to be inserted into a retention mechanism, the end plug comprising:

a receiving portion for being received in the roll of material;

an end face defining a contact plane for contacting the retention mechanism;

a bearing member for being inserted into the retention mechanism, the end face being situated between the bearing member and the receiving portion, the bearing member comprising:

a bearing pin comprising at least a first portion of a first outer diameter, a second portion of a second outer diameter, and a third portion of a third outer diameter, the second portion being situated between the first portion and the third portion, and the second outer diameter being smaller than the first outer diameter and the third outer diameter, wherein the third portion being positioned closer to the end face than the first portion; and at least one locking portion for locking the end plug in an end position in the retention mechanism, the locking portion forming part of the bearing member and being situated closer to the end face than the second portion and the third portion of the bearing pin, wherein the locking portion has at least one outer diameter that is larger than the first, second and third outer diameters of the bearing pin.

2. The end plug according to claim 1, wherein an intersection position of a first surface with the bearing pin is spaced apart from the end face by 2 mm.

3. The end plug according to claim 2, wherein a second surface is inclined with respect to the longitudinal axis of the bearing pin by an angle of 119°.

4. The end plug according to claim 3, wherein the locking portion is further positioned in a zone defined by:

a third surface extending to the end face from an intersection position of the third surface and the bearing pin, the third surface being inclined with respect to the longitudinal axis of the bearing pin by an angle of 122°; and a fourth surface extending towards the end face from an intersection position of the fourth surface and the bearing pin, the fourth surface being inclined with respect to the longitudinal axis of the bearing pin by an angle of 141°;

the locking portion being positioned either between a first surface and a second surface or between the third and the fourth surface.

5. The end plug according to claim 1, wherein the end face defines the contact plane for contacting the retention mechanism, the contact plane facing toward a counter surface.

6. The end plug according to claim 5, wherein an intersection position of a first surface with the bearing pin is spaced apart from the contact plane by 2 mm.

7. The end plug according to claim 1, wherein the locking portion is defined by a truncated cone, the base of the truncated cone being situated adjacent the end face and the top of the truncated cone being situated adjacent the bearing pin.

8. The end plug according to claim 7, wherein the top of the truncated cone has an outer diameter substantially corresponding to the third outer diameter of the bearing pin.

9. The end plug according to claim 7, wherein an outer surface of the truncated cone is inclined with respect to the longitudinal axis of the bearing pin by an angle of less than 117°.

10. The end plug according to claim 9, wherein the outer surface of the truncated cone intersects with the bearing pin in a position spaced apart from the end face by less than 2 mm.

11. The end plug according to claim 9, wherein the outer surface of the truncated cone intersects with the bearing pin in a position spaced apart from the contact plane by less than 1.5 mm.

12. The end plug according to claim 1, wherein the locking portion is rotationally symmetric with respect to the longitudinal axis of the bearing pin.

13. The end plug according to claim 1, wherein the locking portion is defined by a ring-shaped structure situated on the end face.

14. The end plug according to claim 13, wherein summit sections of the ring-shaped structure define the locking portion.

15. The end plug according to claim 13, wherein the ring-shaped structure is situated closer to the end face than the second portion of the bearing pin.

16. The end plug according to claim 1, wherein the locking portion is defined by a stepped structure situated on the end face.

17. The end plug according to claim 16, wherein at least one corner portion of the stepped structure defines the locking portion.

18. The end plug according to claim 16, wherein the stepped structure is situated closer to the end face than the third portion of the bearing pin.

19. The end plug according to claim 1, wherein the locking portion is defined by a chamfered structure situated on the end face.

20. The end plug according to claim 19, wherein at least one portion of the chamfered structure defines the locking portion.

21. The end plug according to claim 19, wherein the chamfered structure is situated closer to the end face than the third portion of the bearing pin.

22. The end plug according to claim 1, wherein the locking portion is defined by a basically cylindrical structure situated on the end face.

23. The end plug according to claim 22, wherein at least one corner portion of the basically cylindrical structure defines the locking portion.

24. The end plug according to claim 22, wherein the basically cylindrical structure is situated closer to the end face than the third portion of the bearing pin.

25. The end plug according to claim 22, wherein the cylindrical structure carries a chamfer that defines the locking portion of the cylindrical structure.

26. The end plug according to claim 1, wherein the locking portion being defined by a hemispherical structure and/or other substantially spherical surface.

27. The end plug according to claim 26, wherein at least one tangential portion of the hemispherical structure and/or other substantially spherical surface defines the locking portion.

28. The end plug according to claim 26, wherein the hemisphere and/or other substantially spherical surface is situated closer to the end face than the third portion of the bearing pin.

29. The end plug according to claim 1, wherein a position of the locking portion is defined by:

a cylindrical surface with an outer diameter corresponding to the outer diameter of the third portion of the bearing pin; and a first surface extending from an intersection position with the outer diameter of the third portion of the bearing pin to the end face, the first surface being inclined with respect to the longitudinal axis of the bearing pin by 117°.

30. The end plug according to claim 29, wherein the position of the locking portion is situated between the first surface and a second surface extending from the intersection position to the end face, the second surface being inclined with respect to the longitudinal axis of the bearing pin by an angle of 141°.

31. The end plug according to claim 29, wherein the intersection position is spaced apart by 2 mm from the contact plane.

32. The end plug according to claim 31, wherein the first surface intersects the contact plane spaced apart from the cylindrical surface by 4 mm.

33. The end plug according to claim 1, wherein the end face comprises a rim defining the contact plane.

34. The end plug according to claim 1, wherein a counter surface is arranged between the first portion and the second portion of the bearing pin.

35. The end plug according to claim 34, wherein the counter surface extends in a plane at an angle to the longitudinal axis of the bearing pin.

36. The end plug according to claim 1, wherein the end plug comprises a limiting member for limiting a depth of insertion of the receiving portion into the roll of material, one face of the limiting member defining the end face.

37. A roll of material for use in a retention mechanism being provided, at least at one longitudinal end of the roll, with an end plug according to claim 1.

* * * * *